United States Patent [19]

Young

[11] 4,000,686

[45] Jan. 4, 1977

[54] SEPARATING MACHINE AND METHOD OF SEPARATING

[76] Inventor: William G. Young, 79 Atterbury Blvd., Suite 201C, Hudson, Ohio 44236

[22] Filed: Nov. 15, 1974

[21] Appl. No.: 524,251

[52] U.S. Cl. ..... 93/36 A; 93/59 ES

[51] Int. Cl.[2] ..... B31B 1/20; B26D 7/18

[58] Field of Search ..... 83/97, 92, 644, 646, 83/630; 93/36 A, 58.3, 58 R, 59 ES

[56] References Cited

UNITED STATES PATENTS

| | | | |
|---|---|---|---|
| 2,117,797 | 5/1938 | Flynn et al. | 83/97 |
| 2,548,370 | 4/1951 | Hedstrom et al. | 93/36 A |
| 2,690,802 | 10/1954 | Russell | 83/97 X |
| 3,057,241 | 10/1962 | Chambon | 83/646 X |
| 3,653,304 | 4/1972 | Lenoir | 93/36 A X |
| 3,672,250 | 6/1972 | Creffield | 83/92 |
| 3,807,610 | 4/1974 | Mueller, Jr. | 93/36 A X |

*Primary Examiner*—James F. Coan
*Attorney, Agent, or Firm*—John H. Mulholland

[57] ABSTRACT

The separator machine disclosed includes a base and sheet feed means on the base. The sheet feed means includes a conveyor section having a plurality of parallel driven transverse feed shafts rotationally mounted on opposite ends of said shafts to advance the sheets along a guide to a nip roll and a plurality of cooperating idler rolls. The nip roll then drives the sheets to forwarding rolls located on either side of the machine. The forwarding rolls are controlled to have the same peripheral speed as the nip roll and to engage the sheets only along the opposite margins of the sheet parallel to the direction of travel of the sheets. The forwarding rolls move the sheets in register between a pair of opposing dies which move transversely of the sheet feed direction into mutual contact with the sheet at a progression of locations across the sheet to complete separation of the cards from the scrap. The relative transverse motion of the dies is accomplished by links of different lengths driving an upper die platen having a male die mounted thereon toward a lower female die by simultaneous rotation of an end of each of said links in an arc in one direction on one stroke and in the opposite direction in the next stroke. The male die includes a plurality of spaced projecting members for engaging portions of said sheet in the area of said tangs. The female die has a plurality of cutout portions in substantially the same arrangement and the same shape as the die cut cards of a series of sheets to be separated into cards and scrap such that the relative movement of the male and female dies into mutual contact with the sheet forces the cards progressively across the sheet from the scrap portion of the sheet and through their respective cutout portion in the female die to a sensing and automatically lowering elevator. The scrap is then driven from between the dies by the forwarding rolls engaging its opposite margins. A preliminary set of cooperating male and female dies can be provided between the conveyor section and the card and scrap separating dies to punch out internal cutouts in the cards, if desired.

15 Claims, 25 Drawing Figures

FROM FIG. 18
342

70a
CONVEYOR MOTOR ARMATURE
70b
CONVEYOR MOTOR SHUNT FIELD
CONVEYOR CONTROL
70c
CONVEYOR MOTOR THERMOSTAT
347
352a
340
348
CONVEYOR SPEED

FROM FIG. 18

330
361
328
364
358
368
FORWARDING ROLLS MOTOR ARMATURE
356
FORWARDING ROLLS DRIVE CONTROL
336
CREEP SPEED
356
362b
INTEGRAL TACHOMETER
366
370
334
378a
374a
362a
376b
+
-
332
LINE SPEED TACHOMETER

SEPARATING MACHINE AND METHOD OF SEPARATING

BACKGROUND OF THE INVENTION

This invention relates to a machine for separating cards, such as are used in packaging and the like, from the scrap of paperboard sheets from which they have been die cut, except for small integral connecting tangs. The cards may be box blanks or backing cards for blister packaging or any other type of card which is made by die cutting paperboard sheets. Often, the paperboard blank sheets are printed and then transported to an elevator and moved by elevator into a feeder and then into a die cutting machine. From the die cutting machine, they are transferred by means of a conveyor away from the machine to a storage or separator station.

The separating operation of the prior art has been widely performed by mechanically forcing scrap from the plane of the sheet. With the advent of mass produced packaging cards for wide distribution of consumer goods, however, a more rapid and economical manner of separating the cards from the sheet scrap has been desirable. One attempt at solving this problem is illustrated in U.S. Pat. No. 3,807,610, issued to Arthur R. Mueller, Jr. Apr. 30, 1974 and its parent patent U.S. Pat. No. 3,670,939 issued June 20, 1972. Various other stripping machines also have been developed over the years, but they have not been effective or economical because of their propensity to jam, when on occasion, the integral tangs holding the partially severed cards and blanks together did not fully tear. Moreover, other prior art designs to hold the scrap required "corking" about the die projections within the punching and stripping apparatus to insure the stripping of the paperboard cards from the scrap.

The present invention is the result of a unique mechanical and electrical combination which permits elimination of many heavy mechanical moving elements such as mechanical gripper bar assemblies that have been traditional in the die cut sheet stripping machines of the prior art.

Brief Description of the Invention

The novel separator machine of this invention includes a base and a sheet feed means mounted on the base. The sheet feed means includes a conveyor section having a plurality of parallel driven transverse feed shafts rotationally mounted on opposite ends of said shafts to advance the sheets along a guide to a nip roll and a plurality of cooperating idler rolls. The nip roll then drives the sheets to complimentary pairs of forwarding rolls located on either side of the machine. The forwarding rolls are controlled to have the same peripheral speed as the nip roll and to engage the sheets only along the opposite margins of the sheets parallel to the direction of travel of the sheets. The forwarding rolls move the sheets to a location in register between a pair of opposing dies. The dies then move transversely of the sheet feed direction into mutual contact at a progression of locations across the sheet to complete the separation of the cards from the scrap. The relative transverse motion of the dies is accomplished by links of different lenghts driving an upper die platen having a male die mounted thereon toward a lower female die by simultaneous rotation of an end of each of said links in an arc in one direction on one stroke and in the opposite direction on the next stroke.

The male die includes a plurality of spaced projecting members for engaging portions of said sheet in the area of said tangs. The female die has a plurality of cutout portions of substantially the same arrangement and the same shape as the die cut cards of a series of sheets to be separated into cards and scrap. The relative movement of the male and female dies into mutual contact with the sheet, forces the cards progressively from the scrap portion of the sheet and through their respective cutout portions in the female die to the platform of an automatically lowering elevator. The scrap is then driven from between the dies by the forwarding rolls in engagement with its opposite margins parallel to the sheet feed direction.

A preliminary set of cooperating male and female dies can be provided between the conveyor section and the card and scrap separating dies to punch out internal cutouts in the cards, if desired.

The entire machine function is electrically controlled through a circuit as will be hereinafter further described in greater detail in connection with the illustrated embodiment. The circuit includes motors for driving the nip roll, dies, forwarding rolls, elevator and transverse shafts of the conveyor. The elevator and die both have clutch-brake type reversing drives appropriately controlled by the circuit through a controller in a manner that will be described hereinafter in detail.

In operation of the car punching line of the type contemplated to include the novel separator, printed sheets are usually moved up an elevator to a feeder and into a cylindrical or platen type die cutter. From the die cutter, the die cut paperboard sheets, with their integral connecting tangs retaining the scrap and cards within a mutual plane, are ultimately transferred to the separator conveyor section. The separator conveyor section transverse feed shafts drive the die cut sheet along a guide forward to the nip rolls which in turn advance the die cut sheet toward the forwarding rolls by engaging their opposite margins parallel to the direction of travel of the sheet until a first switch is contacted. The first switch acts to slow down the forwarding rolls to a lesser velocity until the sheet moves into engagement with a second switch. The second switch stops the sheet and actuates the circuit to start the die cycle. Other functions performed by the circuit of the novel separating machine will be discussed in the detailed description of the illustrated embodiment.

After the die has completed its stroke, the scrap is advanced by the forwarding rolls out of the separator machine and another sheet moved into register with the dies. The cards, of course, having been punched through the female die are stacked on the elevator platform. The elevator platform has a detector which controls its height relative to the machine to lower the elevator platform as the card stack height increases.

With this broad understanding of the novel machine and its function, it will be understood that the entire system may be automated so that the separator machine can be operated with little, if any, attention from an operator. It should be pointed out, in this regard, however that there are manual controls available for operating the various elements and performing the desired functions independently.

BRIEF DESCRIPTION OF THE DRAWINGS

A more complete understanding of the invention can be had from the following drawings and specification.

In the Drawings.

DETAILED DESCRIPTION OF THE ILLUSTRATED EMBODIMENT

Figure 1:
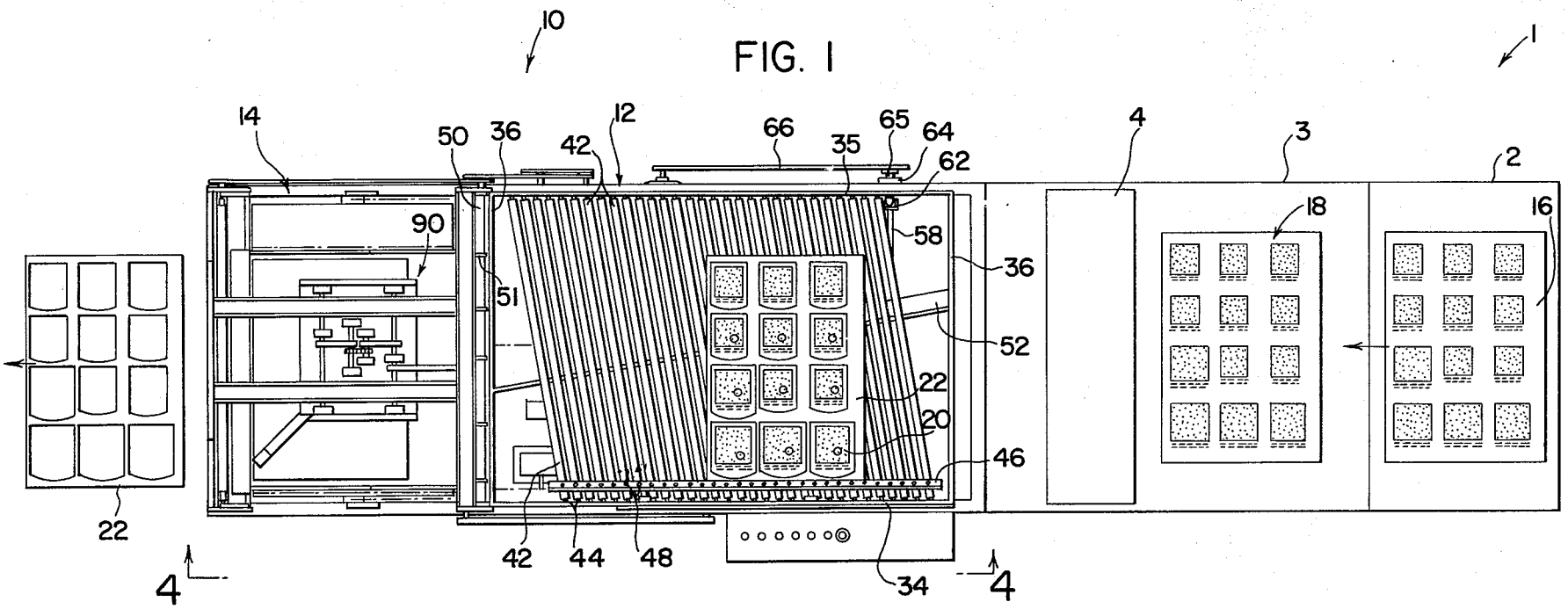
FIG. 1 is a schematic plan view of a card producing line which includes the novel separator machine made according to the principles of this invention.

The numeral 1 generally designates a card producing line which includes in series; a feeder 3, a cylindrical or other conventional die cutter 4, and the novel separator machine of this invention generally designated by the numeral 10. The separator machine 10 includes a conveyor section 12 and a separator die section 14. A stack of printed paperboard sheets 16 is shown on the elevator 2. One printed paperboard sheet 18 from the stack 16 is shown on said feeder 3 about to enter the cylindrical or other conventional die cutter 4. Another printed paperboard sheet 18 which has been die cut except for small integral connecting tangs which hold the cards 20 to scrap section 22 is shown on the conveyor section. It will be noticed that the card 20 die cut in the sheets 18 are of different sizes and are in a configuration or arrangement on the paperboard sheets 18 such that the margins of scrap 22 between the cards are of different widths. This combination form of die cut printed cards on the paperboard sheet 18 would provide a problem for many conventional prior art stripping or separating machines but the flexibility to make any type of die cut card arrangement on paperboard sheets is to be considered one of the features of the novel separator apparatus of this invention.

Figure 2:
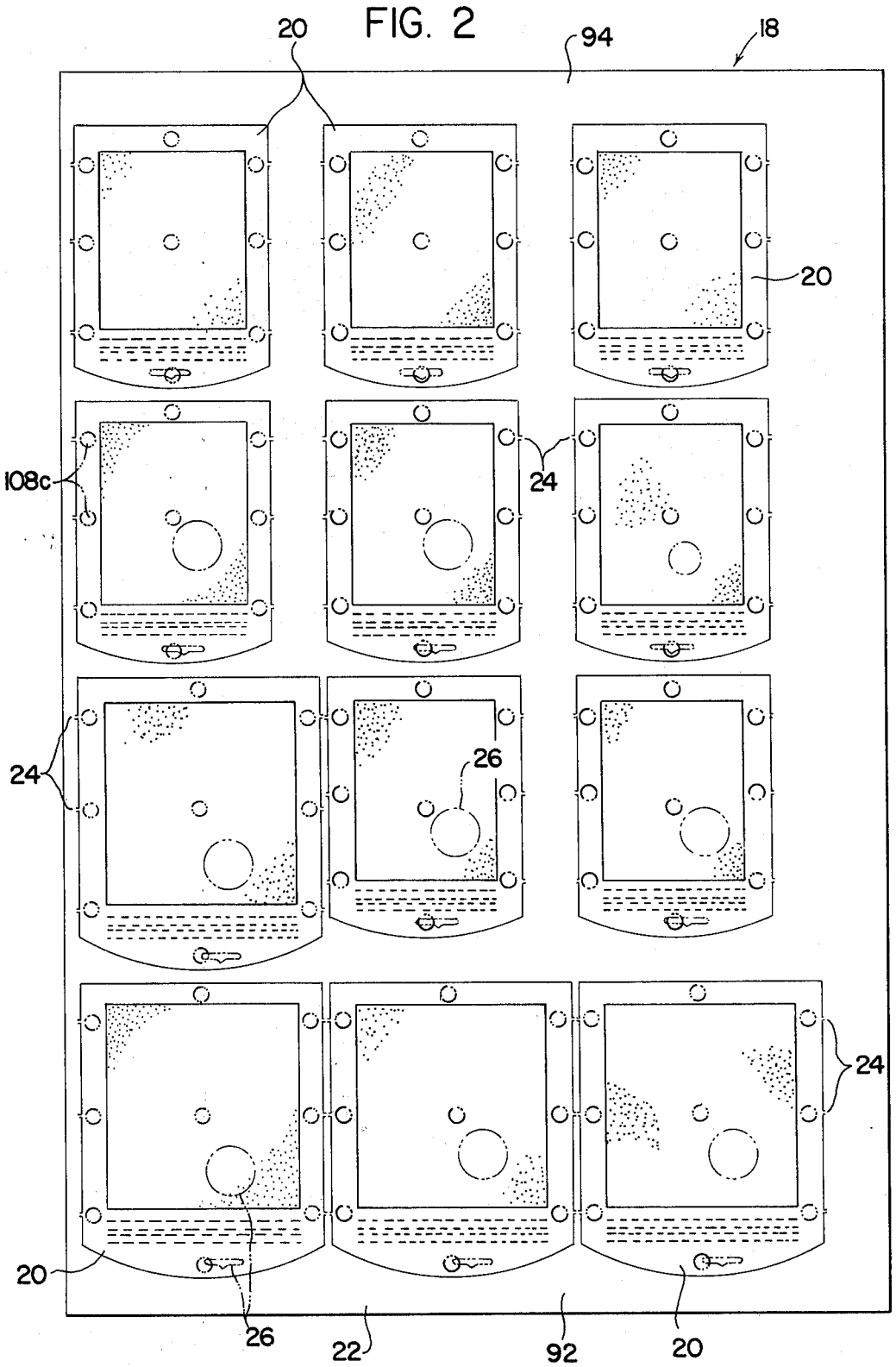
FIG. 2 is a plan view of a paperboard sheet which has been printed and die cut with certain optional internal cutouts illustrated in phantom.

A die cut sheet 18 with its card portions 20 and scrap portion 22 is shown in the conveyor section 12 of the separator machine of FIG. 1. A scrap portion 22 is shown on the side of the separator die section 14 opposite from the section 12 as it is ejected from the machine. FIG. 2 shows in more detail the sheet generally designated 18, its printed card portions 20 and its scrap portions 22. Also illustrated in FIG. 2 are the interconnecting tangs 24 which hold the card portions 20 in the same plane as the scrap portions 22 until the cards 20 are removed in the separator die section 14. Internal cutouts 26 are schematically illustrated as they are sometimes required in paperboard cards of the type being produced by the line 1. Although these internal cutouts 26 are shown in phantom, the illustrated embodiment does not include a specific die station to separate them from the cards 20. It should be obvious to one skilled in the art from the hereinafter provided detailed description of the invention that such a die section could be provided between the conveyor section 12 and the separator die section 14 in the same manner that the separator die section 14 is provided.

Figure 3:
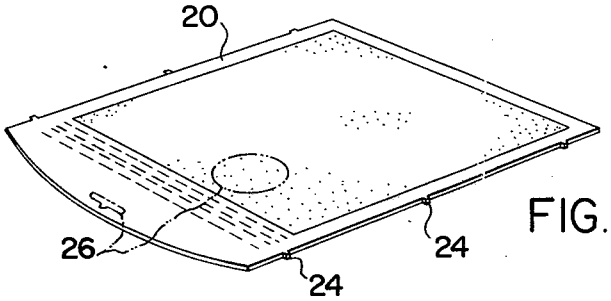
FIG. 3 is a perspective view of a card which has been separated from the scrap of a paperboard sheet of the type illustrated in FIG. 2.

A perspective view of the printed and punched card 20 showing it separated from the scrap portion 22 of the paperboard sheet 18 by means of the severed tangs 24 is illustrated in FIG. 3. The potentially desirable internal cutouts 26 are also shown in phantom in this view.

Figure 4:
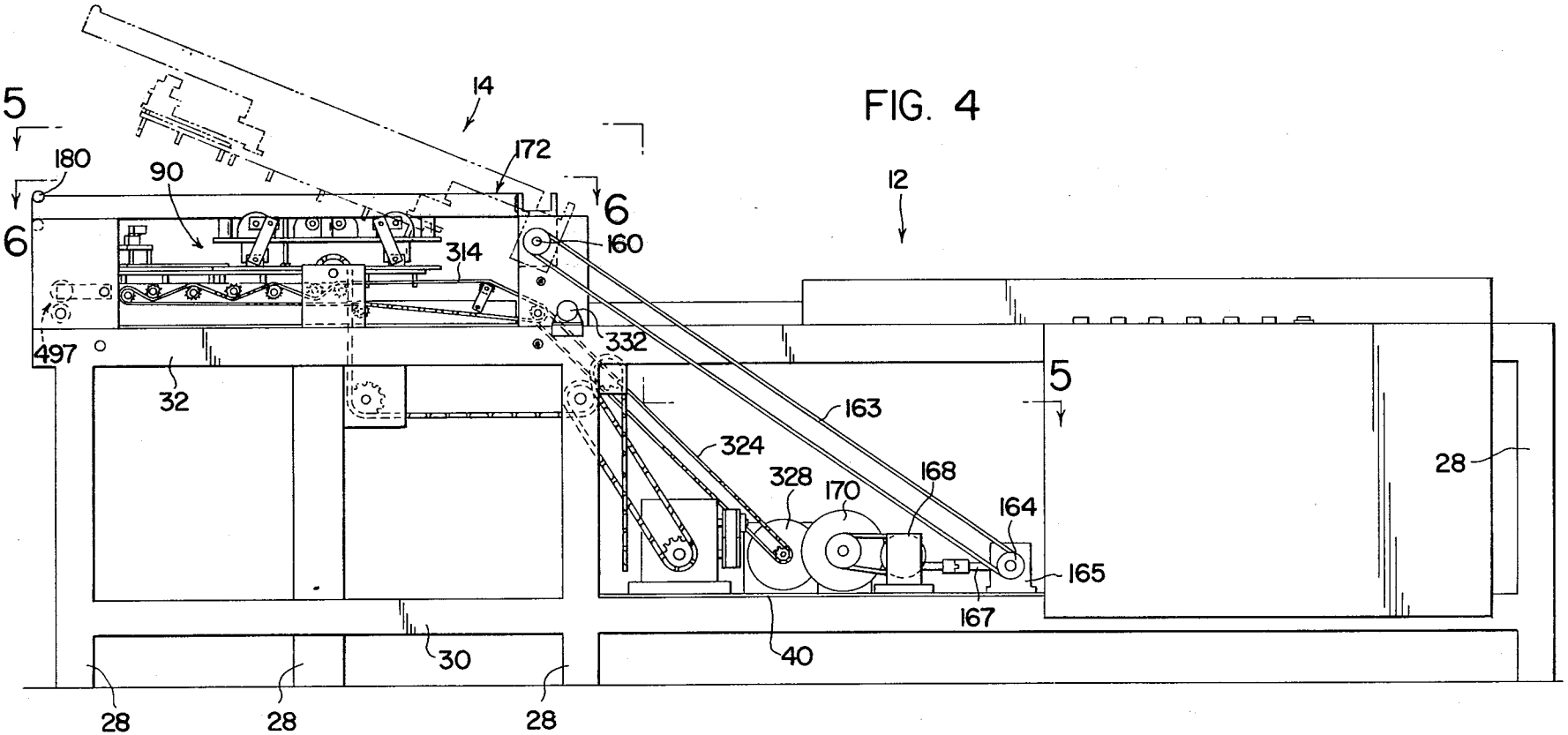
FIG. 4 is a side elevational view taken along the line 4—4 of FIG. 1.

In FIG. 4 it will be seen that the separator machine 10 has a base 27 made up of legs 28, lower horizontal support means 30 and upper horizontal support means 32. The legs 28 and horizontal support means 30 and 32 are integral structural members secured together by welding, bolting or other means. Under the conveyor section 12 of the separator 10, is a platform 40 which spans from one of the lower horizontal support members 30 to the other horizontal support means 30 to provide a support for a plurality of power supplies, prime movers and drive means which perform the various mechanical driving functions of the separator machine in a manner that will be described in detail hereinafter.

Figure 5:
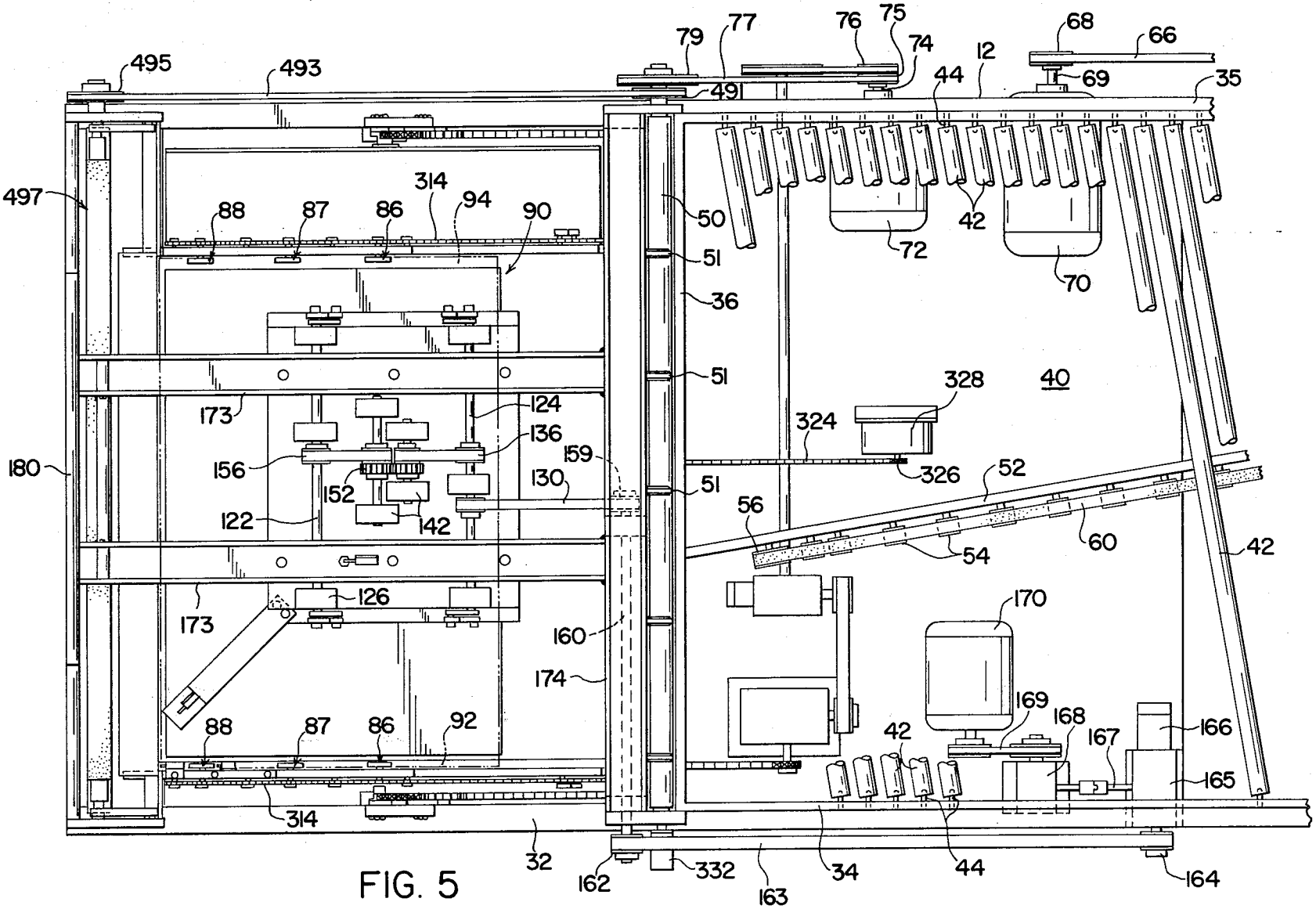
FIG. 5 is a partial plan view of the card and scrap separator of the invention with certain portions of the conveyor section broken away for clarity.

As shown in FIG. 5, mounted on the upper support means 32 in the area of the conveyor section 12 of the separator 10 are angularly projecting frame members 34 and 35 which together with their transverse interconnecting members frame 36 support a plurality of parallel driven transverse feed shafts 42 rotationally mounted at their opposite ends by means of a plurality of pins 44 received in openings in the shaft ends. In effect then, the parallel shafts 42 are mounted in an acute or skewed angle with respect to the travel of the sheet and in a parallel arrangement between end centers on pins 44 projecting respectively from frame members 34 and 35. The angle of skew when viewed from the top, drives the sheets 18 against and along a guide member 46 shown in FIG. 1. The guide member 46 has a plurality of rotational ball seats 48 that contain balls which act as hold down means in the same manner as is illustrated in the Mueller patents referred to above. the guide means 46, when the shafts 42 are rotationally driven by belt 60 shown in FIG. 5, the sheet 18 advances toward the nip roll 50 and its cooperating idler rolls 51. Between the transverse frame members 36 of the mounting frame for the rotationally mounted rolls 42 and under the rolls 42 is a transversely extending elongated member 52 having a plurality of rotationally mounted crowned idler rolls 54 along one side thereof. At one end the transverse member 52 is an idler pulley 56 and at the opposite end (not shown) is a drive pulley mounted on a conveyor drive shaft 58 shown in FIG. 1.

The drive shaft 58 drives the belt 60 over the crowned pulleys 54 and 56 with the belt 60 in engagement with each of the shafts 42. The belt 60 accordingly frictionally drives shafts 42 to advance the sheet 18 along the guide 46 and toward the nip roll 50. The drive shaft 58 in this conveyor section is connected by means of a universal joint 62 to the output shaft of a reversing gear box 64. Reversing gear box 64 has an input shaft 65 which is driven by means of a belt 66. As seen in FIG. 5, a pulley 68 mounted on the output shaft 69 of conveyor motor 70 drives belt 66.

Figure 6:
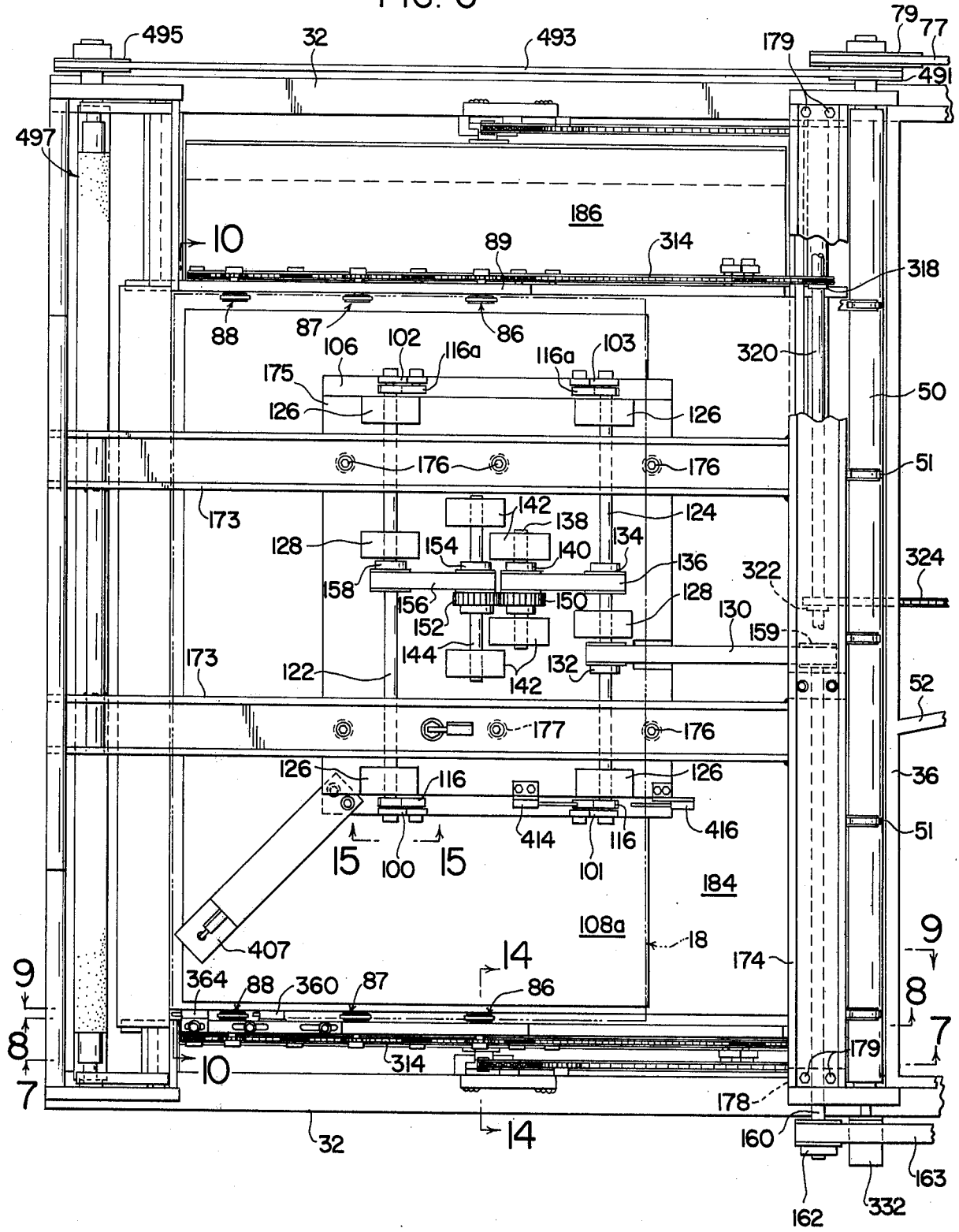
FIG. 6 is a plan view of the die separator section of the machine taken along the line 6—6 of FIG. 4.

After the leading edge of the sheet 18 is moved by means of driven shafts 42 between the nip roll 50 and the cooperating idler rolls 51, as is perhaps best illustrated in FIG. 6, sheet 18 is fed forwardly into the separator section 10. The nip roll 50 is driven by a motor 72 (FIG. 5) having an output shaft 74 with pulleys 75 and 75 thereon. Pulley 75 drives a belt 77 which, by means of pulley 79 on its end, drives the nip roll 50.

Figure 7:
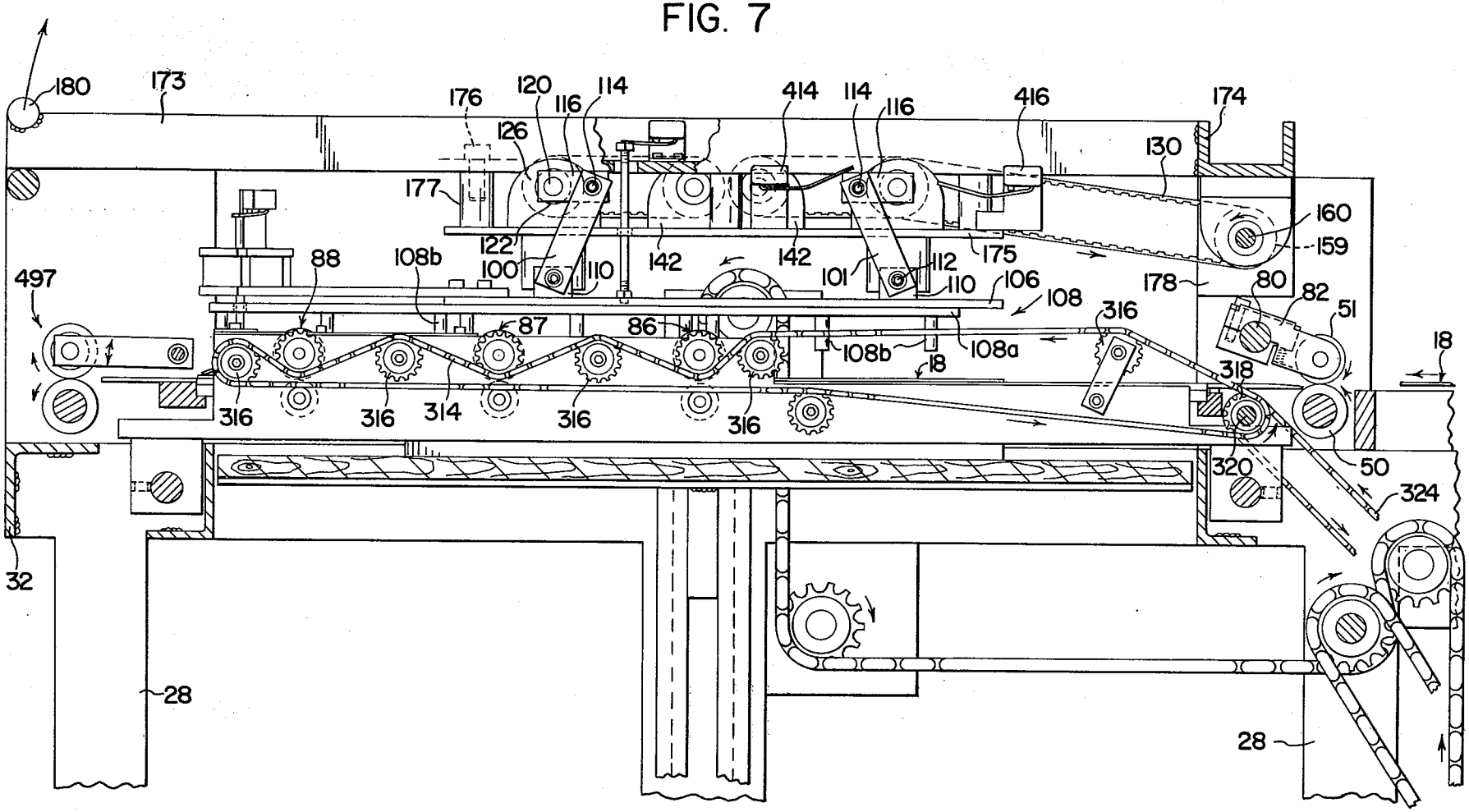
FIG. 7 is a cross-sectional elevational view taken along the line 7—7 of FIG. 6.
Figure 8:
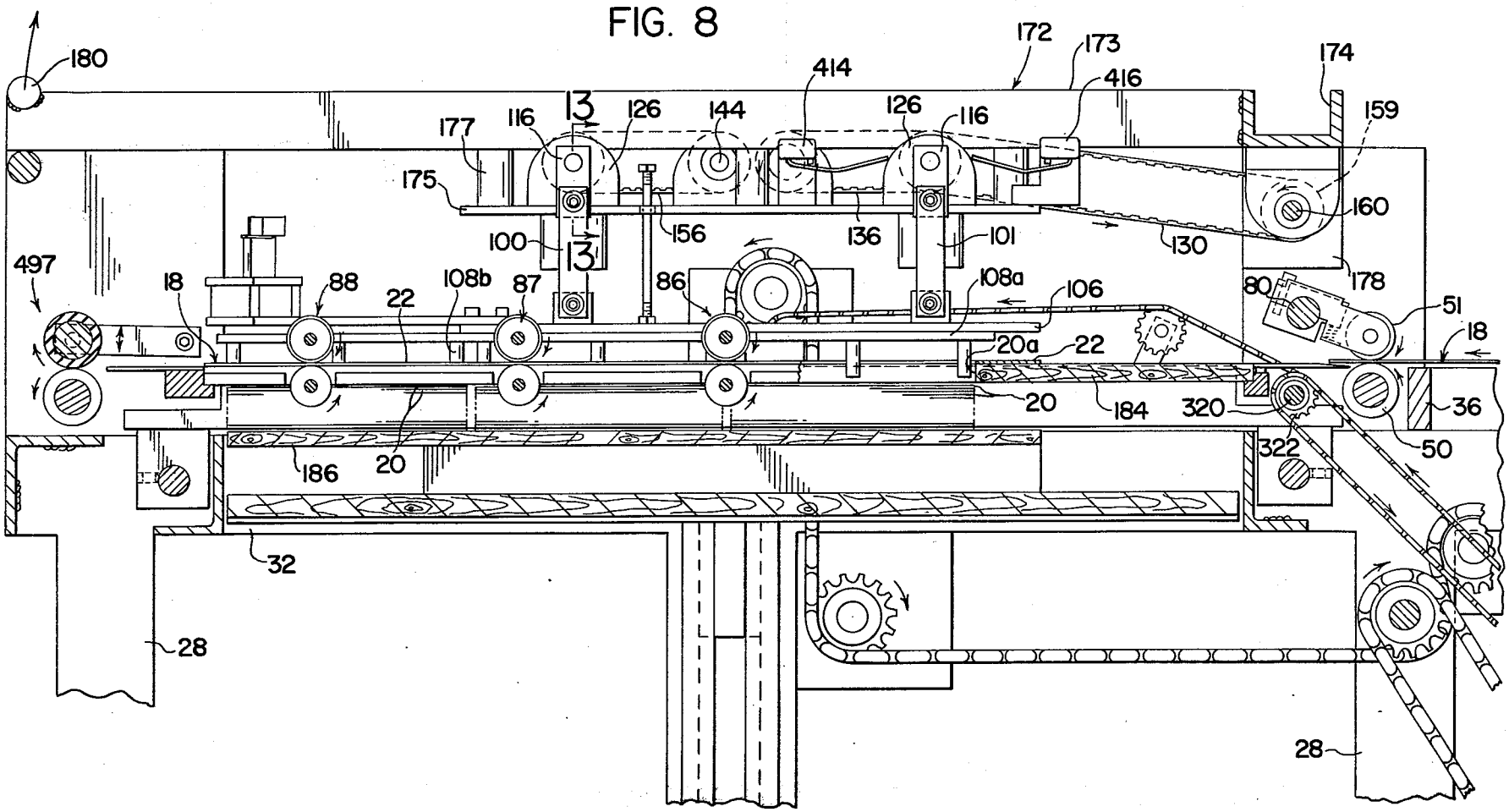
FIG. 8 is a cross-sectional elevational view taken along the line 8—8 of FIG. 6.
Figure 9:
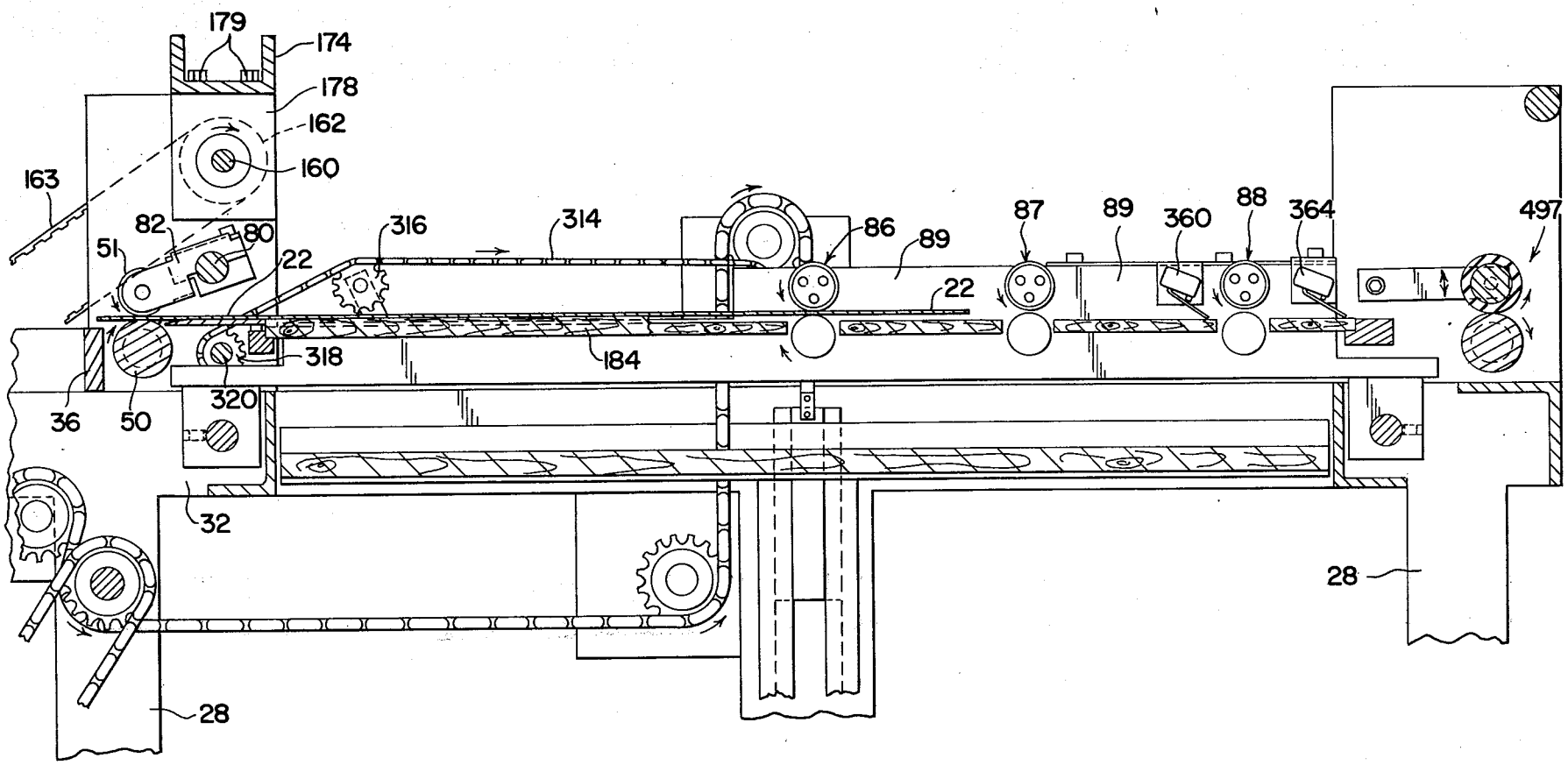
FIG. 9 is a cross-sectional elevational view taken along the line 9—9 of FIG. 6.
Figure 10:
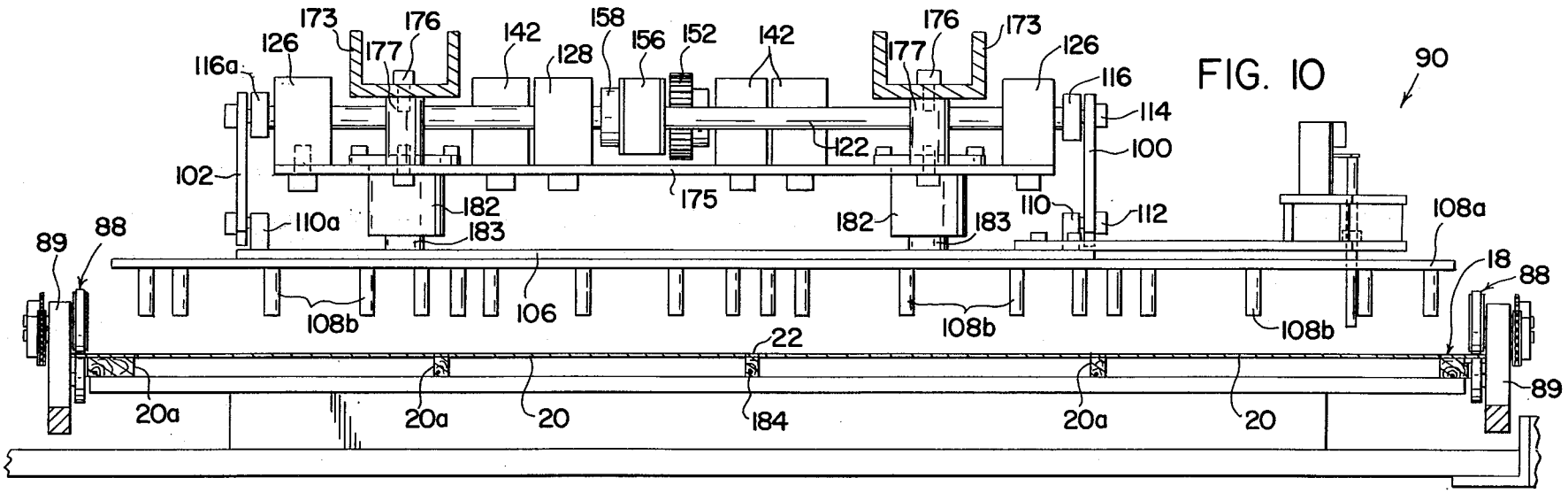
FIG. 10 is a cross-sectional elevational view taken along the line 10—10 of FIG. 6.

The idler rolls 51 are mounted individually over the nip roll 50 on a shaft 80 by means of bracket 82 (FIG. 7). Idler rolls 51 provide the opposing force to insure positive frictional drive of the sheets 18 through the nip roll toward pairs of forwarding rolls 86, 87 and 88. FIGS. 7, 8 and 9 are views taken along the line 7—7, 8—8 and 9—9 of FIG. 6 showing sheets 18 and the scrap 22 therefrom in different feed positions.

Within the die section 14 of the separator machine 10, pairs of forwarding rollers 86, 87 and 88 are located at opposite positions on separate supports 89 mounted inside of upper horizontal support means 32. The pairs of forwarding rollers 86, 87 and 88 grip the opposite margins 92 and 94 of the sheets 18 and after they are clear of the nip roll 50 they are slowed down and fed into a position of rest in register with a pair of opposing dies generally designated by numeral 90, which separate the card portions 20 from the scrap portions 22. Subsequent activation of the forwarding rollers 86, 87 and 88, removes the scrap portion 22 from the position of rest in register between the dies 90 while a new sheet 18 to be separated is advanced to the position in register between the dies. The operation of this feed means will be described in detail hereinafter.

Opposing dies 90 move transversely of the sheet feed direction into mutual contact with the sheet 18 at a progression of locations across the sheet to complete separation of the cards 20 from the scrap portion 22. The relative transverse motion of the dies is accomplished by links 100, 101, 102 and 103. These links have their lower ends connected to a die platen 106. Mounted on the die platen 106 is a male die 108. The die platen 106 is mounted on the links 100, 101, 102 and 103 by means of apertured ears 110 and **110*a* welded or otherwise secured thereto. The ears associated with links 102 and 103 are labeled 110*a* in the interest of clarity in discussing FIGS. 15–17**.

Figure 13:
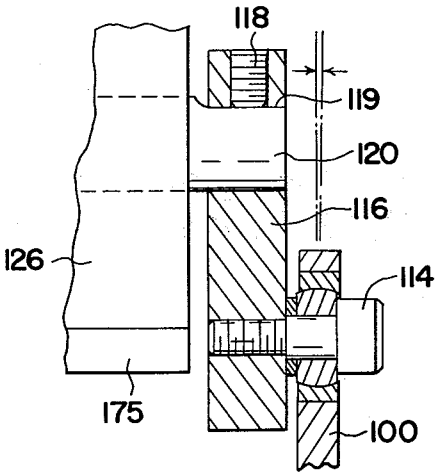
FIG. 13 is an enlarged cross-sectional elevational view taken along the line 13—13 of FIG. 8.

Pivot means 112 make the connection between the apertured ears **110, 110*a* and the links 100, 101, 102 and 103. The upper end of the links are attached by means of pivot means 114 to linking blocks 116 on the left side of the die structure and 116*a* on the right side. In addition to the pivotal motion of the pivot means 112 and 114, as will be seen in FIG. 13, pivot means 112 and 114 have a freedom of motion accomodated by means of a ball bushing or other appropriate mechanical connection to permit slight movement of the links 100, 101, 102 and 103 in a plane other than parallel to the links 116 and 116*a*. The necessity for this non-planer freedom of motion will be understood upon an understanding of the action of the dies progressively across the sheet 18 to separate the cards 20 from scrap portion 22**.

The links **116, 116*a* act through pivot means 114 to drive the upper ends of the links 100, 101, 102 and 103. Adjacent their ends opposite pivot means 114 are secured, by means of set screws 118 and flats 119, to stub shafts 120 links 116, 116*a* which extend from the opposite ends of drive shafts 122 and 124. The links 116 and 116*a* drive the upper ends of links 100, 101, 102 and 103 through arcs of approximately 180°; thereby causing transverse and reciprocating movement of the lower ends of links 100, 101, 102 and 103 so as to move the male die 108 up and down transversely to the direction of travel of sheets 18** in a substantially vertical direction.

Figure 15:
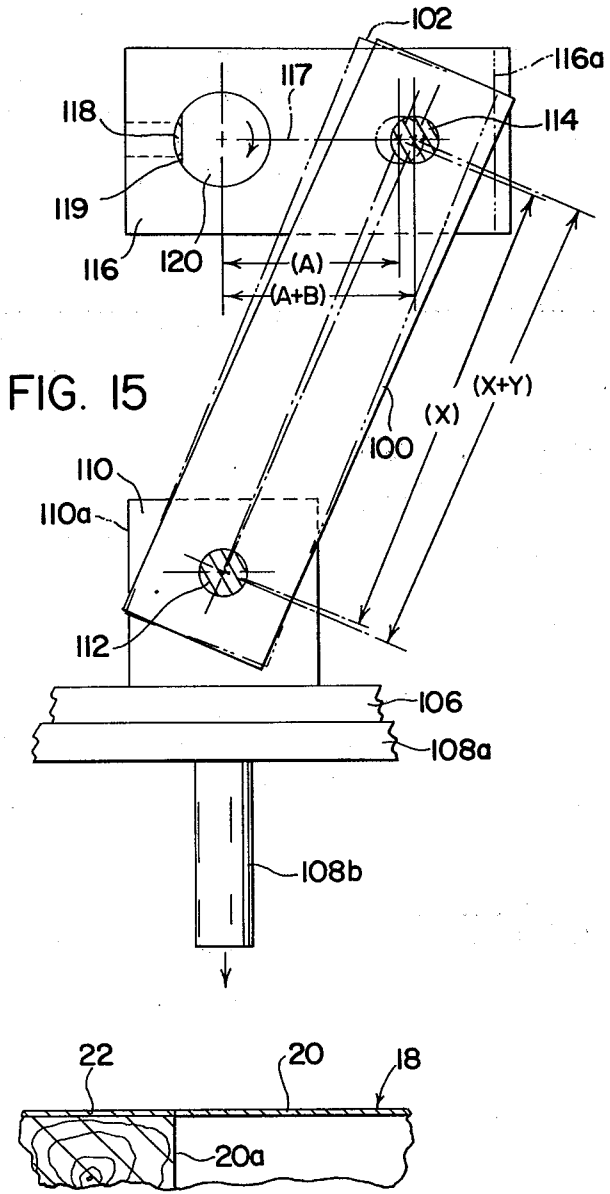
FIG. 15 is a somewhat schematic and elevational view taken along the line 15—15 of FIG. 6.

As seen in FIG. 15, the stub shafts 120 on the ends of driven shafts 122 and 124 have their centers of rotation at the same horizontal elevation as the centers of rotation of the pivot means 114. Accordingly, a line 117 drawn between the centers of rotation of stub shafts 120 and pivot means 114 in links 116 and **116*a* is oriented horizontally. Along the horizontal line 117 the centers of both the pivot means 114 of link 100 and the centers of the pivot means 114 of the link 102 lie in the same horizontal line. The distance between the centers of the link 100 pivot points 114 and 112 is equal to (X + Y) while the distance between the centers of the pivots 114 and 112 of the line 102 illustrated in phantom behind link 100 is only (X), that is, it is smaller by an amount (Y). The distance between centers of pivot points 120 and 114 of the lines 116 is (A + B). The distance between centers of the pivot points 120 and 114 of its equivalent line 116*a* illustrated in phantom behind link 116 and in association with link 102** is only (A), that is, it is smaller by an amount (B).

Figure 11:
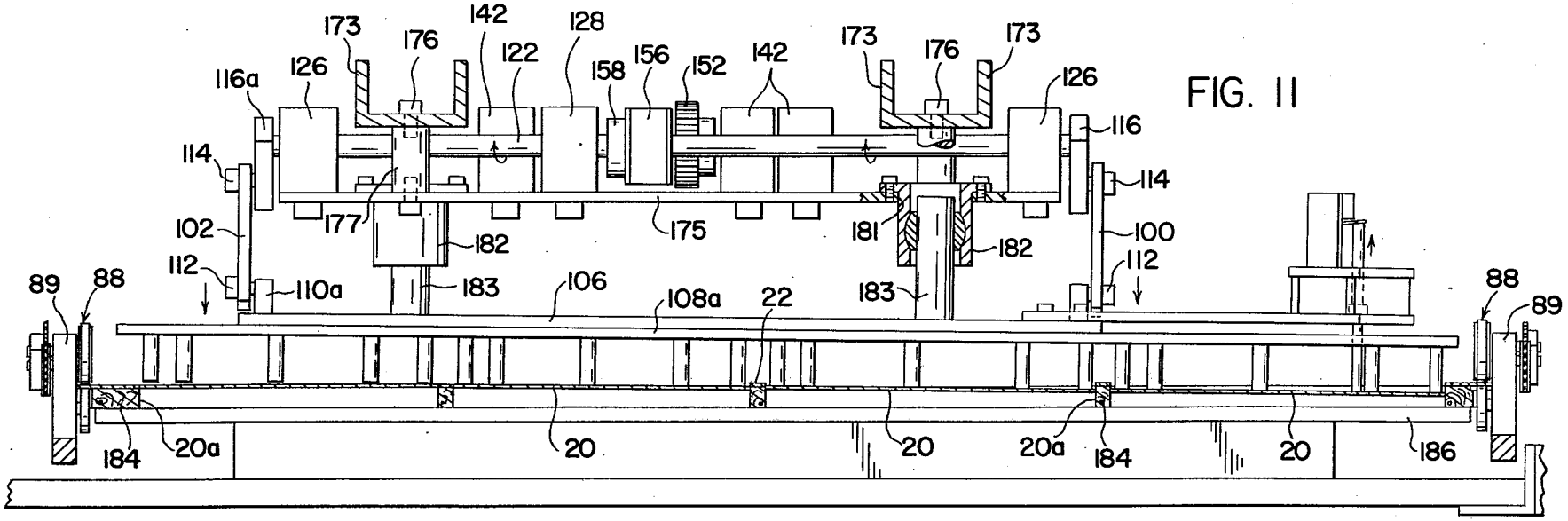
FIG. 11 is a cross-sectional elevational view taken along the line 10—10 of FIG. 6 showing the male die in a partially down condition from that of FIG. 10.
Figure 12:
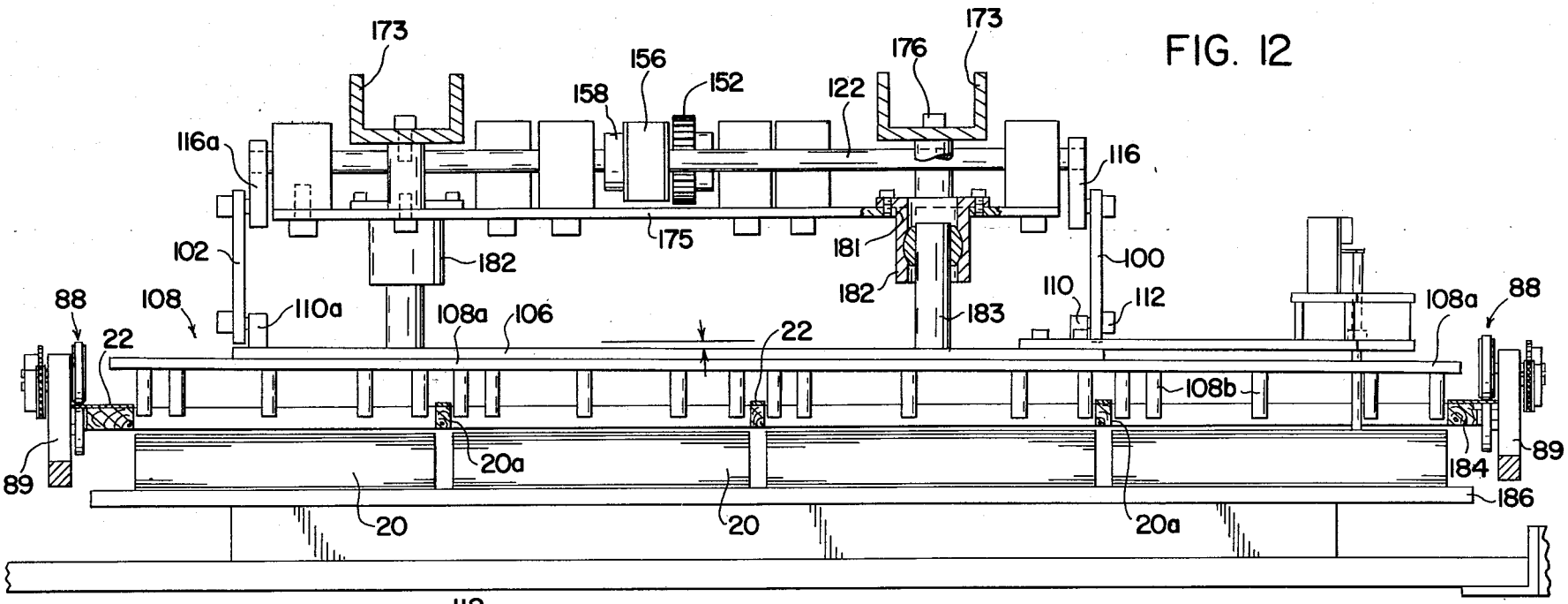
FIG. 12 is a cross-sectional elevational view taken along the line 10—10 of FIG. 10 with the male die at the completion of its downward travel.
Figure 17:
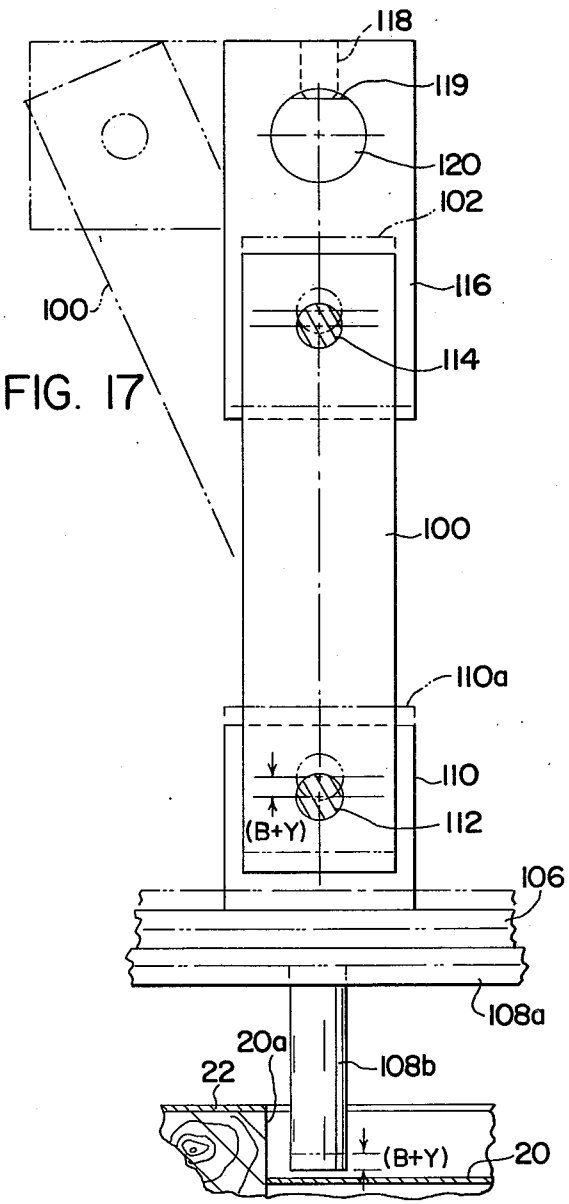
FIG. 17 is a view similar to FIG. 15 with the male die at the completion of its downward travel as illustrated in FIG. 12.
Figure 16:
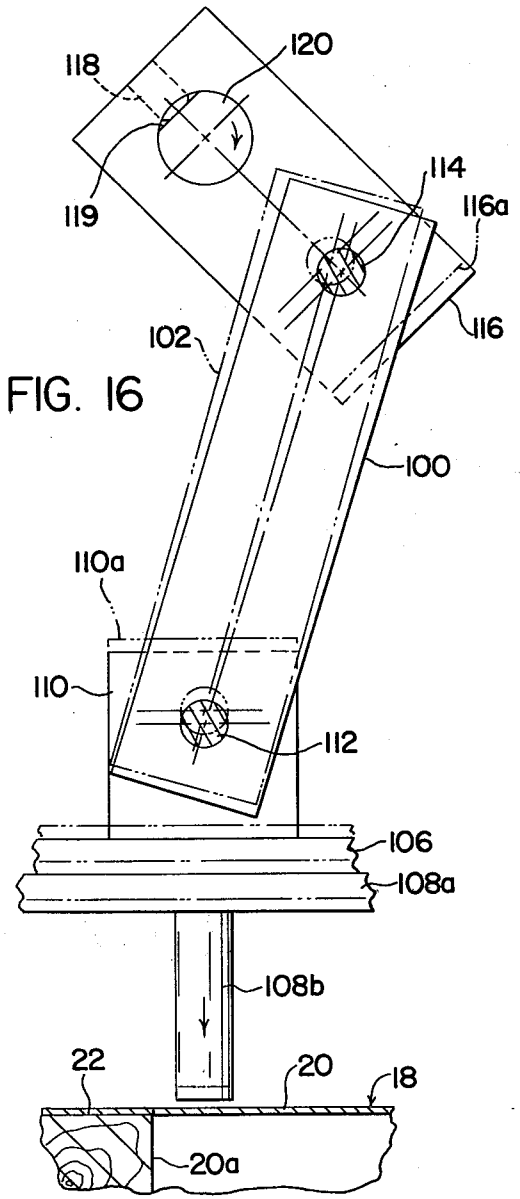
FIG. 16 is a view similar to FIG. 15 with the link in a position for the die to be partially down, as illustrated in FIG. 11.

When the shafts 112 and 124 rotate, and accordingly the stub shafts 120 on the ends thereof rotate, the links 116 and **116*a* are both driven through an arc of 180°. FIG. 16 shows the position of all the links after the first 45° of travel of the links 116 and 116***a*. FIG. 17 shows the position of all of the links after 90° of travel with the 180° position shown in phantom. It will be seen that the ear 110 on the right side of the male die structure travels downwardly farther than the ear 110*a* on the left side. Therefore the right side of the die platen 106 looking at the extremely down position of FIGS. 11 and 17 is lower than the left side. This is so because of the fact the distance between pivot centers for link 116 is (A + B) while for link 116*a* the distance between pivot centers is only (A), and the distance between pivot centers of link 100 is (X + Y) while for link 102 the distance between pivot centers is only (X). Link 101 is the same length between pivot centers as link 100 and link 103 is the same length between pivot centers as link 102. Accordingly, the ears 110 on the right side of the die platen 106 have traveled the distance of (B + Y) farther than the ears 110*a* on the left side of the platen 106 have traveled during the first 90° of rotation of shaft 120. With the component of greater length (B) coming from the difference in length between centers of pivot means of the links 116 and 116*a* and the component of greater length (Y) coming from the difference between in length between centers of pivot means of the links 100 and 102.

The significance of this difference is distance is that while links 116 and 116*a* are going through a rotation of 180°; in the same period of time the right side of the die platen 106 is going faster both downwardly and upwardly because it is moving a distance farther than the left side by an amount 2 (B + Y). In other words, it is traveling a further distance in the same time. The nature of the progressive separation of the cards 20 from the scrap 22 will be obvious when this motion is considered since this action necessarily gives what may be termed a "karate" or "scissoring" type of relative motion to the opposing dies during the separating function.

The drive shafts 122 and 124 are journaled both adjacent their ends in journal boxes 126 and intermediate their lengths in internal journal boxes 128 adjacent where they are belt driven. The shaft 124 is driven by a belt 130 through a pulley 132. The pulley 132 is mounted on one side of a journal box 128 and on the opposite side thereof is a pulley 134 from which a belt 136 drives a shaft 138 through a pulley 140. The shaft 138 is journaled in journal boxes 142 which may be of the same type as those previously mentioned. A shaft 144 adjacent and parallel to the shaft 138 is also journaled adjacent its ends in a pair of journal boxes 142 such that a gear or pinion 150 fixedly mounted on the shaft 138 drives a similar gear or pinion 152 on shaft 144 in intermeshing tooth engagement therewith. The shaft 144 through a pulley 154 fixed thereon drives a belt 156. The belt 156, through a pulley 158 mounted intermediate the ends of shaft 122 adjacent intermediate journal box 128, drives the shaft 122.

As previously stated and described, the shafts 122 and 124 respectively, through links 116 and 116*a* fixedly mounted on the ends thereof, drive the links 100, 101, 102 and 103 through an arc approximately 180°. The links 100 and 101 move in opposing directions on the right side of the die structure as do the links 102 and 103 on the left side to lower and raise the die. This balances out vibration from torque and inertia as the dies are cycled through an arc of 180° in one direction during one complete stroke and 180° in the opposite direction on the next stroke. The die platen 106 and the male die 108 attached thereto, by means of bolts or other mechanical fastening means thus move toward and away from the female die transversely into mutual contact with a sheet 18 in register therebetween during each 180° arc of the links 116 and 116*a*.

The belt 130 provides the drive first in one direction and then in the reverse direction by means of a belt 130 driven from a pulley 159 which is drivingly attached to drive shaft 160. A pulley 162 and belt 163 associated therewith rotate shaft 160.

The belt 163 is driven by means of pulley 164 on the output shaft of a clutch 165. A fail-safe brake 166 in connection with clutch 165 changes a constant speed input from shaft 167 into a reversing drive at the output shaft and pulley 164. The shaft 167 receives its proper constant speed through gear box 168 which is driven through pulley and belt means, generally designated 169, in association with the output shaft of the die motor 170.

The die support frame 172 is made up of welded channel members 173 extending in the direction of travel of the sheets 18 and member 174 extending transversely thereto. The support frame 172 supports a plate 175 upon which all of the journal blocks 126, 128 and 142 are mounted. Plate 175 is supported by means of bolts 176 through channel members 173 and shims or spacers 177. At the opposite ends of the channel member 174 a pair of projecting support ears 178 are bolted to the ends of channel member 174 by means of 179 to support and rotationally mount about shaft 160 the frame 172 so that the frame 172 and the entire male die structure can pivot about the shaft 160 without disturbing the proper tension on the length of its drive belt 130.

A cross-support reinforcing bar and handlebar 180 is provided on the outer end to rigidify the frame structure 172 and provide convenience in raising and lowering the upper die carriage 172 about the shaft 160 for access to the die area.

As seen in FIG. 11, plate 175 has four apertures 181 into which flanged ball bushing means 182 or mechanical equivalent are bolted, one pair each under the channel members 173. The ball bushing means 182 permit a degree of freedom of movement of the die platen 106, and male die 108 attached thereto, outside of a strict vertical movement. Thus shafts 183 which are mounted on platen 106 to guide same are free to reciprocate at a slight angle from the vertical within said ball bushing means 182 to accommodate the fact that the right side of the platen 106 moves a distance (B + Y) lower than the left side.

In addition to the upper projection support plate 108*a* of the male die 108 a plurality of male die projections 108*a* project therefrom. The pattern of arrangement of projections 108*a* is disclosed in FIG. 2 in phantom as 108*c*. It will be noticed that there is a projection 108*b* for each tang 24 between the card portions 20 and the scrap portions 22 of the sheets 18.

As the karate or scissors action of male die 108, as discussed hereinbefore, moves projections 108*a* progressively across sheet 18 in register between male die 108 and the female die, generally designated by the numeral 184, the tangs 24 on the right side are first severed and then each successive tang 24 of all card portions 20 are severed and the cards are forced through their respective complimentary opening 20*a*. The cards 20 then stack on an elevator platform 186 located below the female die 184. Because of the open nature of male die 108 and female die 184, die suction is no problem and the cards 20 and scrap 22 readily free themselves from both dies without the need of mechanical strippers or corking as hereinbefore mentioned.

Figure 14:
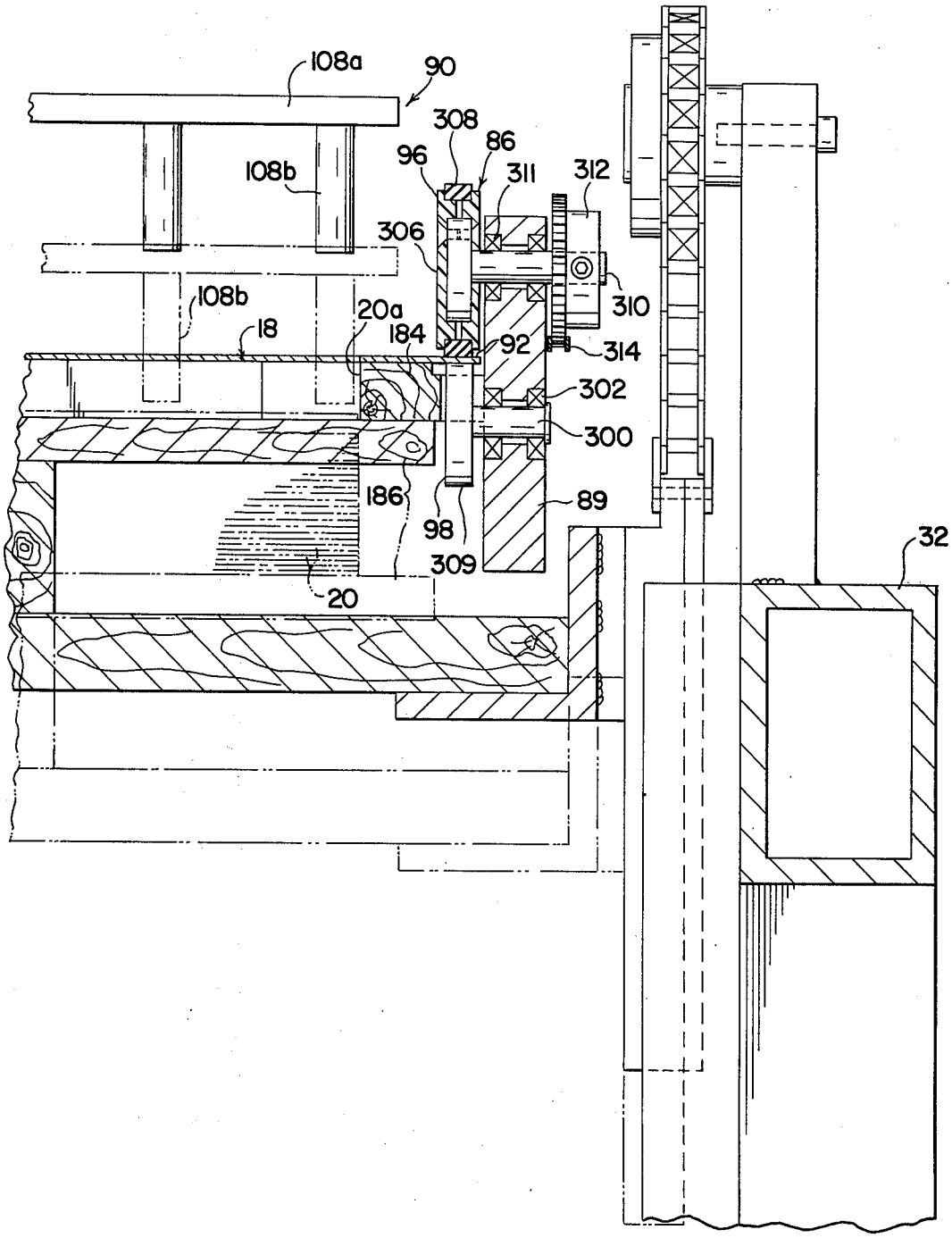
FIG. 14 is an enlarged elevational view taken along the line 14—14 of FIG. 6.

The details of the forwarding rolls and their mounting means can be described in detail as follows. Due to the similar construction of the forwarding rolls only one pair of forwarding rolls will be hereinafter described. It should be understood though that each pair of the forwarding rolls are of the same construction. FIG. 14 is a cross-sectional view of a portion of the separator 10 shown taken along lines 14—14 of FIG. 6. The pair of forwarding drive rolls 86 shown in FIG. 14 includes an upper forwarding drive roll 96 and a lower forwarding roll 98. The lower forwarding roll 98 is fixed to a shaft 300 which shaft is pivotally mounted in a bearing 302 for free turning rotation. The bearing 302 is mounted on the elongated support 89 which is secured to the upper horizontal support means 32. The forwarding roll 96 has generally circular rotary base member 306 with an elastomeric covering 308 surrounding the outer peripheral surface thereof. The elastomeric material is positioned adjacent to the outer peripheral surface 309 of the lower pair of forwarding rolls so as to grip the opposite margins of scrap 22 of the sheet 18 as it is moved through the separator die section 14.

The rotary base member 306 is attached to a shaft 310 which is rotatably journaled by means of bearings 312 in the support means 89. Secured to the shaft 310 is a drive sprocket 312 which is driven by a drive chain 314. When the upper forwarding roll 96 is driven by the drive chain 314 the sheet 18 is driven by the forwarding roll 96 to a position into registry between the opposing dies 90 and after the cards 20 are separated from the scrap portions 22 the forwarding rolls move to eject the scrap from between the opposing dies 90. It should be understood that each pair of forwarding rolls 86, 87 and 88, on both sides of the opposing dies 90 are rotated in a similar manner by a drive chain 314 on both sides of the opposing dies 90.

As seen in FIG. 7, the drive chain 314 is in driving communication with the drive sprockets on each of the pairs of forwarding rolls 86, 87 and 88 with idler sprockets 316 interposed therebetween and at the ends thereof. The idler sprockets are rotatably mounted to the support 84 in conventional manner. Each of the drive chains 314 on each side of the opposing dies 90 are driven by chain drive sprockets 318 which are fixedly connected to the intermediate drive shaft 320. The intermediate drive shaft 320 is rotatably mounted on the upper horizontal support means 32 in any manner well known to those skilled in the art. Between the chain drive sprockets 318 on the intermediate drive shaft 320 is a driven sprocket 322 which is secured to the intermediate drive shaft 320 to rotate the intermediate drive shaft. The driven sprocket 322 is driven by the chain 324 which is in turn driven by the drive sprocket 326 as seen in FIGS. 7 and 5. The drive sprocket 326 is driven by a servo motor generator 328.

The servo motor generator rotates the drive sprocket 326 at a speed which synchronizes the speed of the rotation of the nip roll 50 with the drive speed of the forwarding rolls 86, 87 and 88. This allows the sheet to be advanced from the nip roll 50 and idler rolls 51 and the forwarding rolls 86, 87, and 88 so that no buckling of the sheet 18 appears when the sheet is being simultaneously driven by the nip roll 50 and the first set of forwarding rolls 86.

Figure 20:
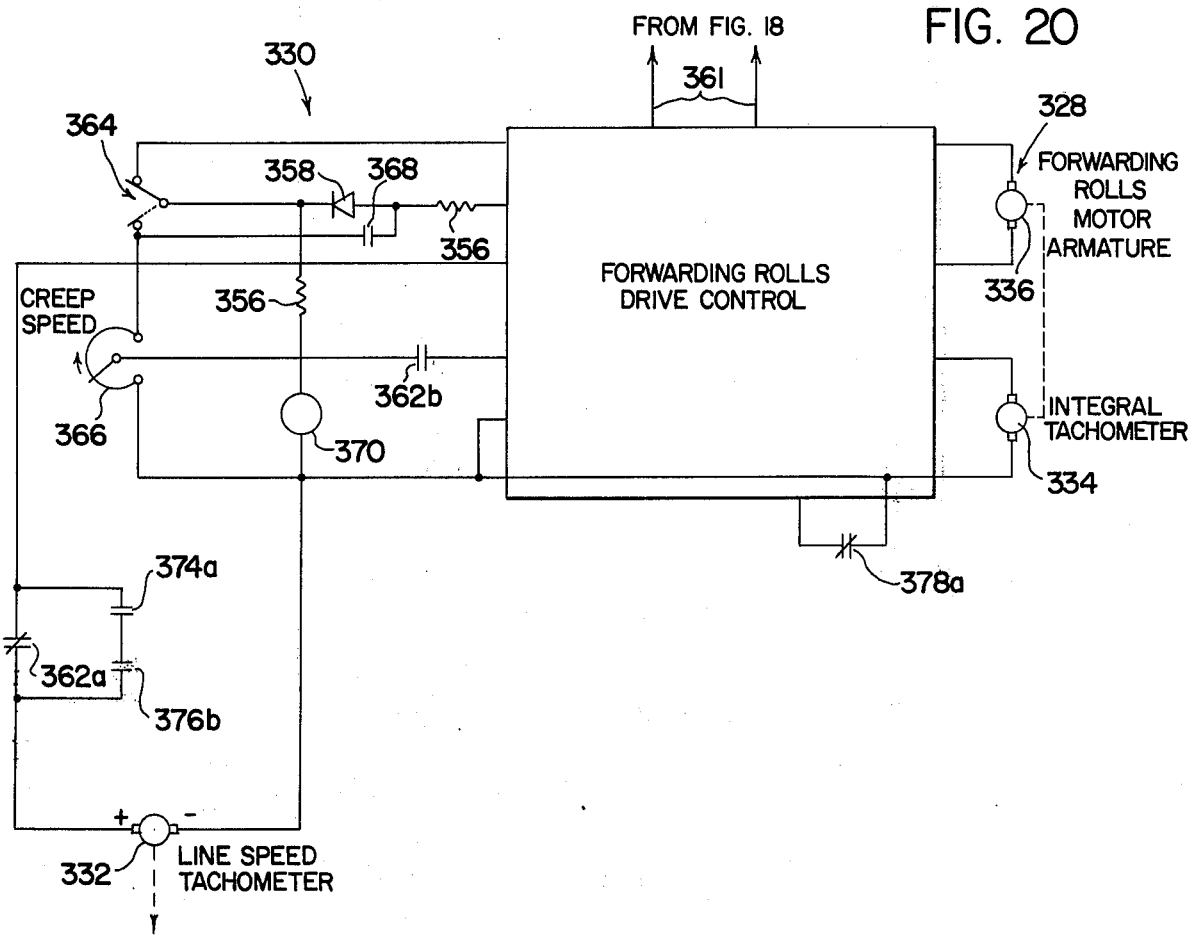
FIG. 20 is a schematic diagram of the forwarding rolls and drive control and associated circuitry.

To provide such a synchronous speed between the forwarding rolls and nip roll 50, the forwarding control circuit 330, as best seen in FIG. 20, is provided. For purposes of clarity, the circuit 330 will be further described hereinafter in connection with the operation of the separator machine. The general function of the circuit 330 is to sense the speed of rotation of the nip roll 50 with a sensor 332 which may be of any construction well known to those skilled in the art, such as a tachometer. The tachometer generator of 332 is connected to the nip roll 50 to provide a signal in the circuit 330 of a voltage dependent on the speed of rotation of the nip roll 50. The speed of the nip roll 50 is proportional to the speed of the sheet 18 as it is moving through the nip and idler rolls 50, 51 respectively.

An integral tachometer, schematically indicated at 334 in the circuit 330, of FIG. 20 is mechanically connected to the motor armature schematically indicated at 336, of the servo motor generator 328 to thereby sense the speed of rotation of the servo motor generator armature 336. The tachometer 334 provides a signal circuit 330 having a voltage dependent on the speed of rotation of the armature 336. The circuit 330 compares the magnitude of the voltages of the signals from the tachometer generator of 332 and 334 and controls the speed of rotation of the servo motor generator armature 336 so as to synchronize the speed of the forwarding rolls 86, 87 and 88 through the drive linkage described hereinabove in connection with the forwarding rolls. It should be understood that during the typical operation of the card producing line 1 of the subject invention, a number of different sheets 18 successively pass through the machine. For simplicity of describing the car producing line 1, the following description will be made in connection with only one sheet 18 as it passes through the card producing line and is separated into card 20 and a scrap portion 22. A stack of printed paperboard sheets 16 is positioned on the elevator device 2, as shown in FIG. 1. The elevator device 2 feeds one printed paperboard sheet 18 at a time onto a feeder 3 which die cuts the sheet 18 into a number of cards 20 as hereinabove described.

Figure 18:
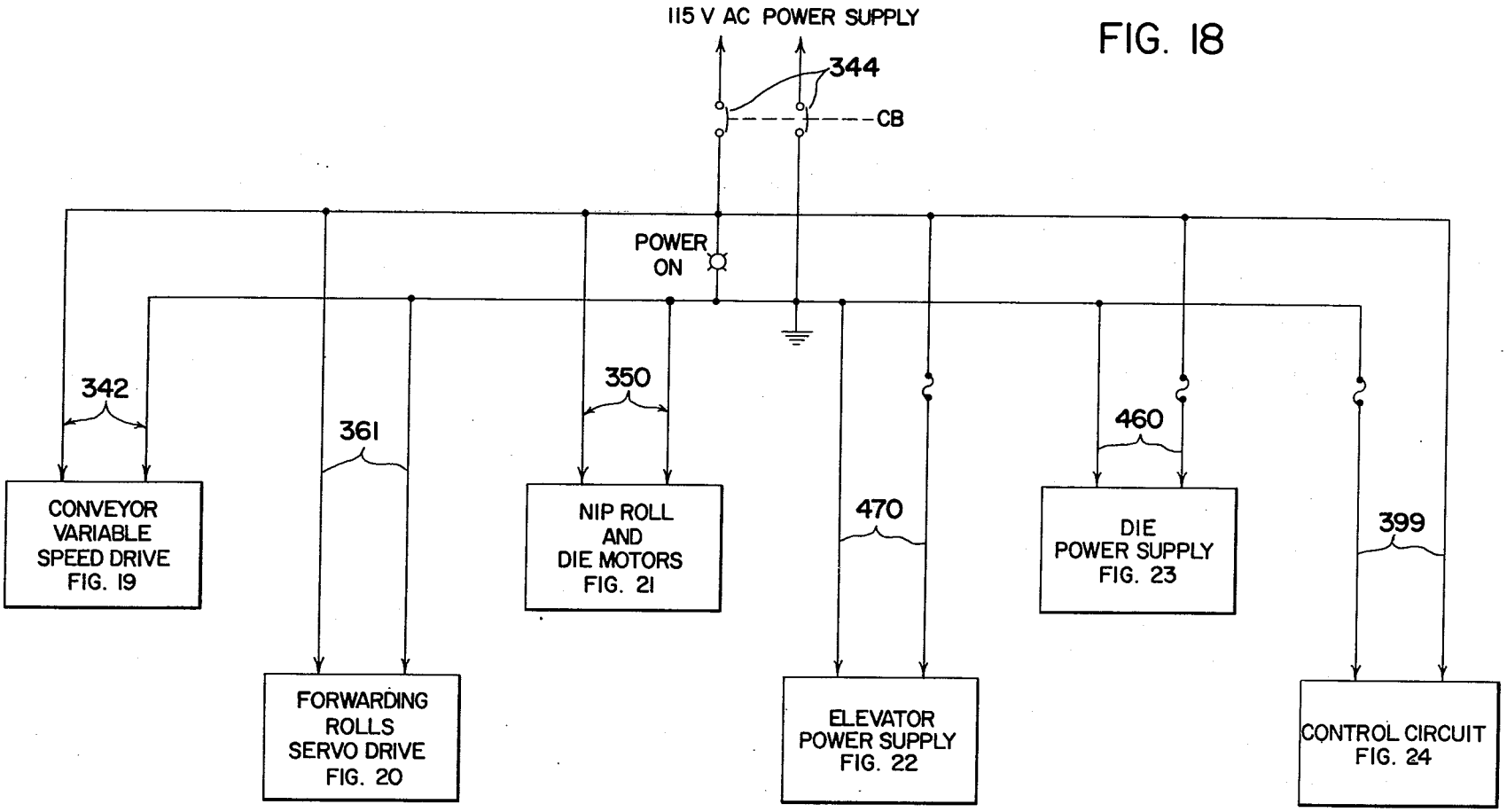
FIG. 18 is a schematic block diagram of the drive means of the separator machine.

The sheet moved from the die cutter 4 to the separating device 10 of the subject invention by means of the conveyor 12. The die cut sheet 18 is received on the conveyor 12 which feeds and advances the sheet along the conveyor to a position adjacent to the coacting nip and idler rollers 50, 51 respectively. The control of the speed of the sheet 18 as it is moved by the conveyor 12 is accomplished with the conveyor control circuitry 340 shown in FIG. 19. A-C power is supplied to the circuit 340 by leads 342 connected to the A-C power supply shown in FIG. 18. The power supply can be turned on or off with the power control switch 344. It should be noted at this point that the power control switch serves to control the supply of power to all of the circuitry associated with or included in the separator apparatus of the present invention.

Figure 19:
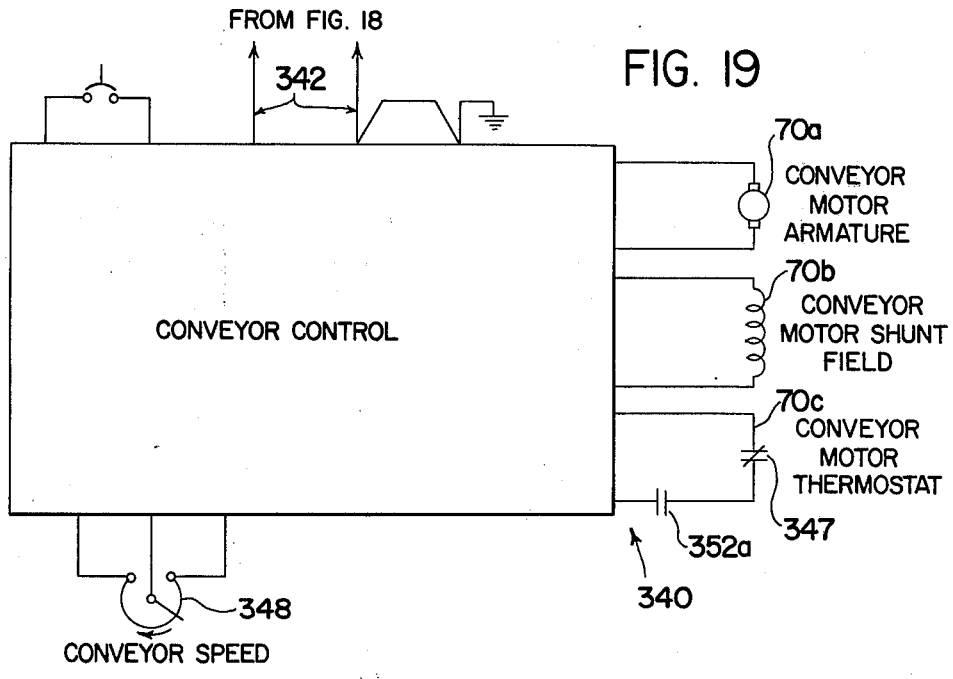
FIG. 19 is a schematic diagram of the conveyor control and associated circuitry.

The conveyor control circuit 340 may be any one of many different designs known to those skilled in the art to perform the functions herein described. The circuit 340 allows the speed of rotation of the armature **70*a* of the conveyer motor 70 to be varied and thereby adjust the speed and timing of the sheet 18 as it is passed along the conveyor 12 so it is timed with respect to previous sheets. The particular circuitry 340** shown in FIG. 19 provides a speed controller 348 which is manually adjusted by the operator so the speed and consequently timing of the sheets moving along the conveyor 12 is controlled. The conveyor 12 feeds the sheets to a position adjacent to the co-acting nip and idler rolls 50 and 51 in timed relationship. This is accomplished by proper control of the conveyor control circuitry 340 on the conveyor motor armature 70*a*, conveyor motor shunt field 70*b* with the protective circuit generally indicated at 70*c* in FIG. 19.

The protective circuit 70*c* includes a conveyor motor thermostat relay having a set of normally closed relay contacts 347. If the motor overheats, the relay contacts 347 will open to stop the conveyor drive motor 70. The normally open start relay contacts 352*a* are also provided to coordinate the movement of the sheets by the conveyor 12 with the remainder of the apparatus shown in FIG. 1. The condition of the contacts 352*a* are changed by activation of start relay coil 352 shown in FIG. 24 and when so changed will allow the conveyor motor 20 to operate.

Figure 21:
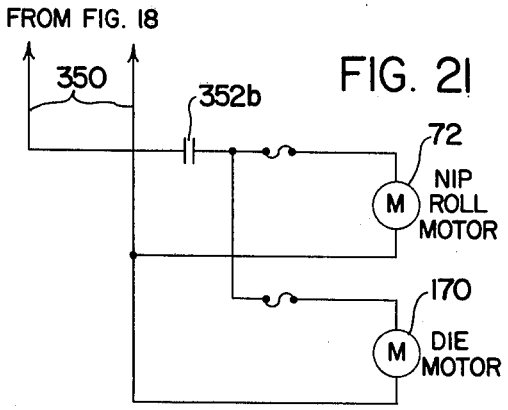
FIG. 21 is a schematic diagram showing the circuit connections between the nip roll motor and the die motor.
Figure 24:
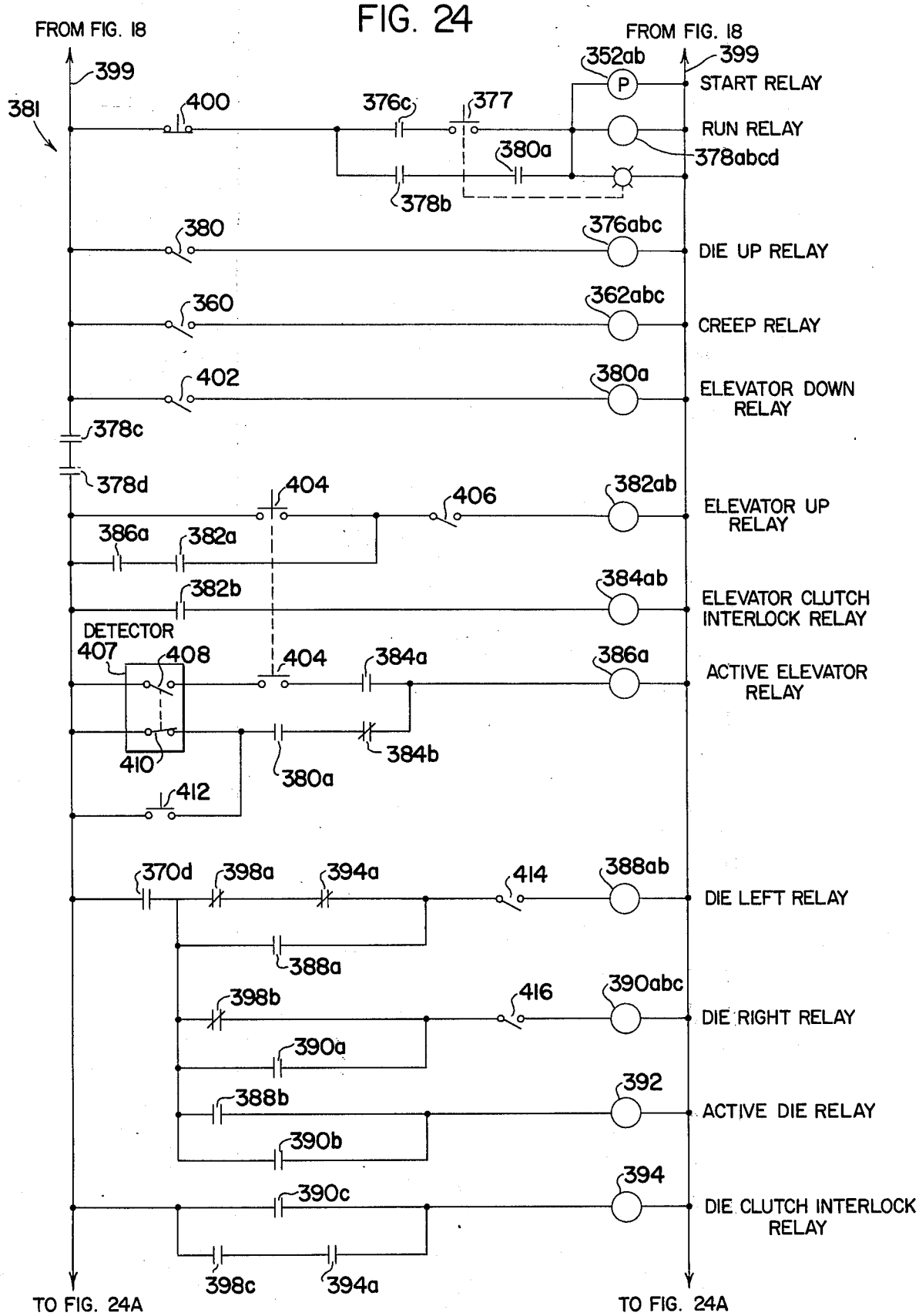
FIG. 24 and FIG. 24(*a*) are circuit diagrams showing the interconnection of various electrical components of the machine with their functions labled for clarity.

FIG. 21 shows a circuit which may be used to provide power to the nip roll motor 72 and die motor 170. The power leads 350 shown in FIG. 21 are connected through the power control switch 344 to the supply shown in FIG. 18. Power is supplied to the nip roll motor 72 and die motor 170 through the normally open start relay contactors 352*b* when the contactors 352*b* are in a closed position. The start relay contactors 352*b* are in a closed condition when the coil 352, shown in FIG. 24, is activated, as will be hereinafter described.

As the sheet 18 is positioned by the conveyor 12 adjacent to the coacting nip and idler rolls 50 and 51 respectively, the nip roll 50 is rotated at a constant speed by means of the nip roll motor 72 as hereinabove described.

FIG. 21 shows a circuit which may be used to provide power to the nip roll motor 72 and die motor 170. The power leads 350 shown in FIG. 21 are connected through the power control switch 344 to the power supply shown in FIG. 18. Power is supplied to the nip roll motor 72 and die motor 170 through the normally open start relay contactors 352*b* when the contactors 352*b* are in a closed position. The start relay contactors 352*b* are in a closed condition when the coil 352, shown in FIG. 24, is activated, as will be hereinafter further described.

The sheet 18 is gripped by the driven nip and the idler rollers 50, 51 respectively and advanced toward the first set of feeder rollers 86 which are initially driven at the same peripheral speed as the nip roller 50 in a manner described above in connection with the servo motor generator 328. The forwarding control circuit 330 controls the speed of the feeder rollers 86, 87 and 88 so that the peripheral speed of the feeder rollers 86, 87 and 88 is equal to the peripheral speed of the nip roll 50 during movement of the leading edge of the sheet 18 from the nip roll 50 to the switch 360 shown in FIG. 9. When the leading edge of the sheet is moving between these two positions, the sheet is moving at a high rate of speed. Power is supplied to circuit 330 by power leads 361.

It is important that the speed of the nip roller 50 and pairs of feeder rollers 86, 87 and 88 are synchronized so that when the leading edge of the sheet 18 reaches the first set of feeder roller 86 there is no buckling or stretching of the sheet 18 due to a lower or higher peripheral speed of the feeder rollers 86 with respect to the peripheral speed of the nip roller 50. The speed of the pairs of feeder rollers, 86, 87 and 88 and the nip roll 50 is synchronized during this period by circuit 330 as follows: the line feeder tachometer generator of 332 is mechanically connected to the nip roll 50 to sense the rotational speed of the nip roll and provide a signal having a voltage proportionate to the speed of the nip roll. The forwarding roll control circuitry 330, FIG. 20, compares the voltage signal provided by the integral tachometer generator of 334 of the servo motor generator 328 to thereby control the speed of the forwarding rollers 86, 87 and 88 at the same peripheral speed as the peripheral speed of the nip roll 50. A resistor and diode 356, 358 respectively are provided in the circuit 330. The sheet 18 continues to be driven at a high speed by the feeder rollers 86, 87 and 88 until its leading edge reaches a sensor 360, as seen in FIG. 9 which may be any conventional sensor such as a limit switch.

When the sheet 18 is sensed by sensor 360, the control circuitry decreases the speed of the sheet 18 so that the sheet moves at a lower speed during the time its leading edge moves from sensor 360 to sensor 364. When the leading edge of the sheet 18 passes under the sensor 360, its presence is detected and the switch 360 closes to energize the creep relay coil 362 shown in FIG. 24.

The creep speed relay coil 362 actuates the normally closed creep relay contactors 362*a* to an open position and thereby removes the voltage from the tachometer generator of 332 so the speed of forwarding rollers 86, 87 and 88 is no longer controlled thereby. The creep relay coil 362 also changes the condition of another set of normally open creep relay contacts 362*b* to a closed position. Activation of the creep relay and closing of switch 360 when a sheet is present serves to change the speed of feeder rollers 86, 87 and 88 to a lower speed which is less than the speed of the nip roll 50 before the leading edge of the sheet reaches the sensor 364 shown in FIG. 9. While the leading edge of the sheet 18 is between the sensors 360 and 364, the sheet is moving at a lower speed due to the decreased speed of the forwarding rollers 86, 87 and 88. The change in the speed of the sheet 18 to the lower speed is effectuated as follows.

When the creep relay 362*b* is closed by tripping switch 360 and so long as the sensor 364 is in the position shown in phantom in FIG. 20 potentiometer 366 is provided to adjust the magnitude of the lower speed or the speed of the sheet 18 between sensors 360 and 364. A sequence relay coil 370 is provided in the circuit 330, as shown in FIG. 20 and performs functions which will be further hereinafter described in connection with the circuitry shown in FIGS. 24 and 24*a*. The relay coil 374 shown in FIG. 24*a* senses when the die was down as will be further described changes the condition of the normally open contacts 374*a* in FIG. 20 to a closed condition. Similarly the die up relay coil 376, shown in FIG. 24, is activated when the die is in an up position and changes the condition of the normally open contactors 376*b* indicated in FIG. 20 so that a sheet is not improperly advanced.

Further protective circuit means are provided by the run relay coil 378, shown in FIG. 24. When the run relay coil 378 is activated, the normally closed run relay contactors 378*a*, shown in FIG. 20, open.

When the sheet 18 reaches the sensor for stopping the sheet 364 the switch 364 is changed from a condition as shown in FIG. 20 by dashed lines to the position shown in the solid lines to thereby stop rotation of the servo motor generator 328, the forwarding rollers 86, 87 and 88 and correspondingly stop the sheet 18. The switch 364 is positioned so that when sheet 18 is stopped, it is in register with the opposing dies 90 and the opposing dies 90 are then in a position to move through their cycle to separate the cards 20 from the scrap section 22.

A substantial amount of circuitry is provided to operate the separating apparatus 10 of the present invention. The steps which are taken to accomplish this separation are controlled by a control circuit, a portion of which is circuitry 381 shown in FIG. 24 and 24*a*. The other portions of the circuitry 381 control and sense the position of the sheet 18, the stack of cards on the elevator and control of the movement of the elevator so that is can accept more cards as the separator machine 10 continues to operate.

It should be understood that when the switch 364 senses that the trailing edge of the scrap from the previous cycle has left position between the opposing dies 90 and the leading edge of the new sheet to be separated has reached the stop position sensed by the sensor 364, a signal in response thereto through the circuitry shown in 381 substantially simultaneously the following steps occur:

1. Stops the forwarding rolls 86, 87 and 88 so the sheet is stopped in register between the opposing dies so as to allow the cards to be separated by the opposing dies 90.
2. Energizes the fail safe brake 166 which is mechanically connected to the opposing dies 90 to allow relative movement between the opposing dies.
3. Energizes a die drive as described in connection with the drive train connected to the drive motor 170 which drives the opposing dies 90.
4. Actuates an initiating circuit means so that forwarding rolls 86, 87 and 88 are activated after a complete cycle of the opposing dies 90 and the opposing dies 90 are in the open position to feed another sheet into position between the opposing dies.

Power is supplied to the circuit 381 by leads 399 as seen in FIG. 24. The circuit 381 includes a manual stop switch 400 which is in a normally closed position but should be an emrgency arise may be activated so as to open the circuit. Throughout this description is should be understood that the relay contactors are in a normal condition, either open or closed, and upon actuation of the coil fo that relay the condition of the contactor will change. The normally open die up relay contactors 376*c* and a manual starting switch 377 are provided in parallel with normally open run relay contactors 378*b* and a set of normally open elevator down relay contactors 380*a*. When this circuit is in a closed condition, the start relay coil 352 and run relay coil 378 are activated to change the condition of their respective relay contactors.

A sensor 380, such a limit switch, is provided to sense when the die is in the up position is illustrated in FIG. 9. The sensor 380, schematically indicated in FIG. 24, is in a closed position when the die is in the up position. When the limit switch 380 is in a closed position the die up relay 376 is activated to change the condition of the contactors associated therewith.

It has been pointed out that the sensor 360 is normally in a closed position when a sheet is present and open when a sheet is no longer present, therefore when the sensor 360 senses the presence of a sheet, the creep relay coil 362 is activated to change the condition of the relay contactors associated therewith.

Means are also provided in circuit 381 to control the raising and lowering of the elevator platform 186. A sensor 402 is provided which is closed until the elevator platform reaches a down position at which time the sensor 402 opens to change the condition of the elevator down relay contactors. Run relay contactors 378*c* and 378*d* are provided under a change in condition when the relay 378 is changing conditions as described above.

The position of the elevator platform 186 is controlled by a portion of the circuit 381. A normally open switch 401 is provided to manually affect the raising of the elevator platform 186. When the switch 404 is manually moved to a closed position the elevator platform 186 may be raised to its up position. Normally open active elevator relay contactors 386*a* and normally open elevator up relay contactors 382*a* are connected in parallel with the manual switch 404. When their conditions are changed or the manual switch is activated and the switch 406 is in a closed condition, the elevator up relay 382 is activated. The switch 406 is positioned to sense when the elevator platform 186 is in the extreme up position so as not to over travel and when the platform 186 is in the up position, it is in an open condition.

The elevator clutch interlock relay 384 is activated when the normally open elevator up relay contactors 382*b* are changed in condition from an open to a closed position.

Mechanically connected switches 408 and 410 constituting a portion of the detector 407 are provided which sense the condition of the pile of cards on the elevator platform 186. When the cards are piled too high, limit switch 408 is normally open and the switch 410 is normally closed. Switch 404 is in normally open condition and is used to raise the platform 186; switches 408 and 404 and the elevator clutch interlock relay 384*a* are in series with each other and in parallel with the switch 410 normally open elevator down relay contactors 380*a* and the normally closed contactors of the elevator clutch interlock relay 384*b*. A normally open manual switch 412 is provided for lowering the elevator platform 186. When the circuit condition is changed the active elevator relay 386 is activated to change the condition of its relay contactors.

To assure that the dies 90 are in the open position, switching means, such as limit switches 414 and 416, are provided to sense when the die is in the up position, either on the left side with switch 414 or on the right side with switch 416. When the die is up, either the switch 414 or 416 is open. The die left relay 388 is activated when normally open switch relay contacts 370*a* and switch 414 are in a closed position and when either the normally closed die cycle relay contactors 398*a* and normally closed die clutch interlock relay contactors 394*a* are in a closed position or when the normally open die left relay contactors 388*a* are closed. The die right relay 390 is activated when the normally open switch relay 370*a* is changed to a closed condition and either the normally closed die cycle relay contactors 398*b* remain in a closed position and the switch 416 is in a closed position or when the normally open die right relay contactors 390*a* are changed to a closed position and the switch 416 is in a closed position.

The activate die relay 392 is activated when the normally open switch relay contactors 370*a* is in a closed condition, and either the normally open die left contactors 388*b* or normally open die right relay contactors 390*b* is in a closed condition.

The die clutch interlock relay 394 is activated when either the normally open die right relay 390*c* or the die cycle relay contactors 398*c* and normally open die clutch interlock relay contactors 394*a* are in a closed position.

Figure 24A:
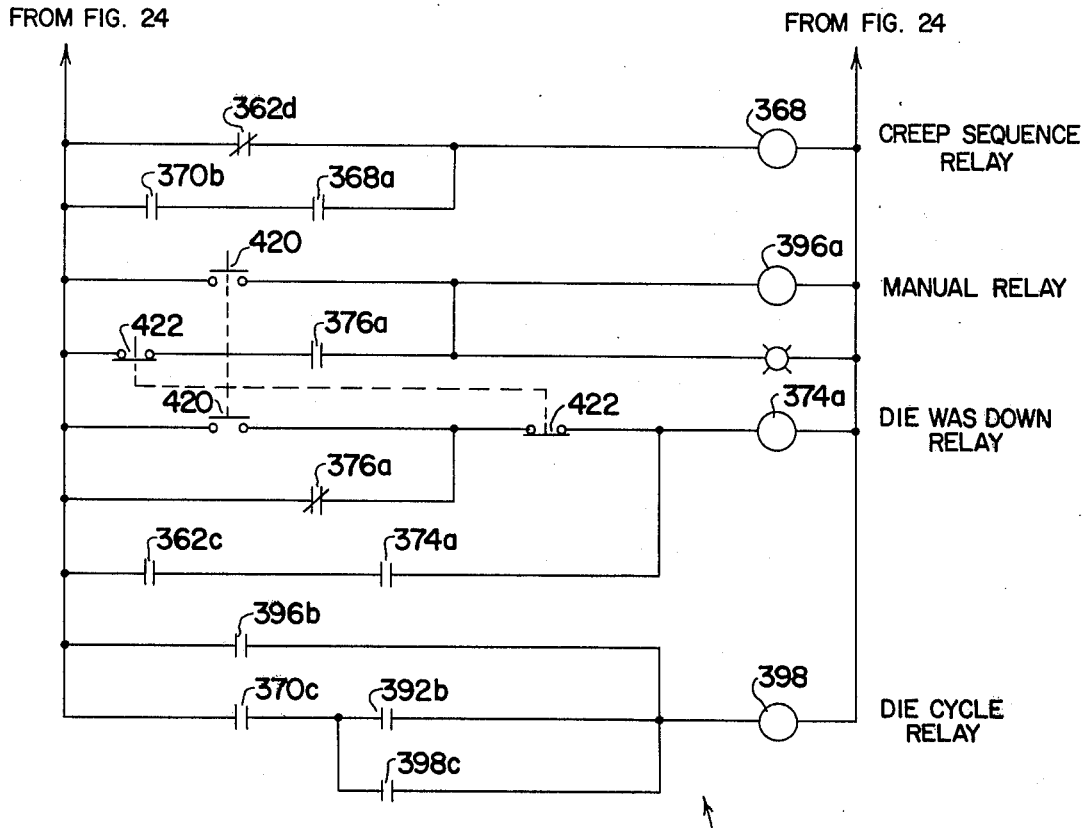

The remainder of circuit 381 is shown in FIG. 24*a*. The creep sequence relay coil 368 is activated when either the normally closed creep relay contactors 362*d* remain in a closed position or when the normally open switch relay contactors 370*b* and normally open creep sequence relay contactors 368*a* are both in a closed condition.

The manual relay coil 396 is activated when either the normally open manual switch 420 is moved to a closed position or the die up switch 422, which is in a normally closed position, is in a closed position and the normally open manual relay contactors 396*a* are in a closed position.

The die was down relay 374 is activated when the normally open manual switch 420 is moved to a closed position or the normally closed die up relay 376*a* remains in a closed position and the normally closed die switch 422 remains in a closed position, as seen in FIG. 24*a*. The die was down relay coil 374 is also activated when both the normally open creep relay contactors 362*c* are in a closed condition and the normally open die was down relay contactors 374*a* are in a closed condition.

The die cycle relay coil 398 is activated when the normally open manual relay contactor 396*b* is closed or when the normally open switch relay 370*c* is in a closed condition and the normally open activate die relay 392*b* or normally open die cycle relay contactor 398*c* is in a closed condition.

Figure 23:
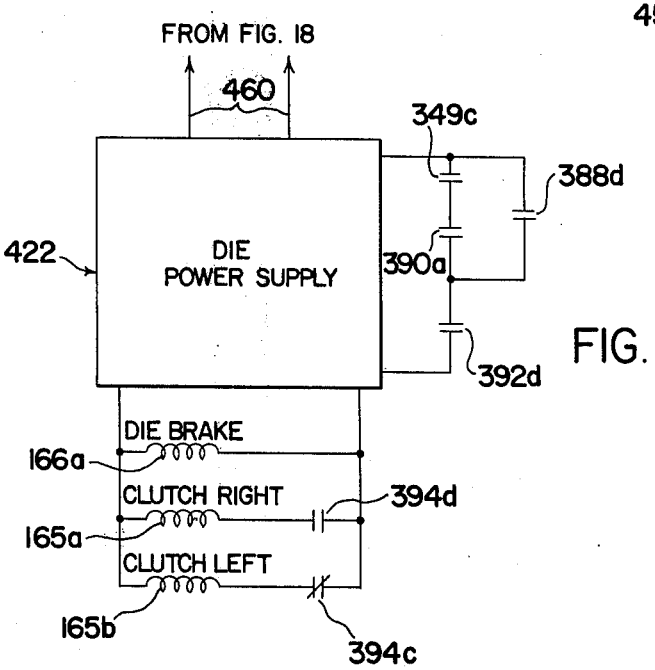
FIG. 23 is a schematic diagram of the die reversing drive power supply and associated circuitry.

The opposing dies 90 are operated by the control circuitry shown in FIG. 23. Leads 460 are connected to the A-C power supply. The normally open die clutch interlock relay contactors 394*c* and the normally open die right contactors 390*d* are in series with each other and parallel with the normally open die left relay 388*d* both of which are in series with the normally open active die relay contactors 392*d* as shown in FIG. 23 which circuitry serves to provide a signal to the die clutch brake power supply 462 so that the fail safe brake 166 and the opposing dies are driven by the clutch 165 as herein described. Die brake coil indicated as 166*a*, FIG. 23, is part of the fail safe brake 166*a* is in a normal stop position but when its condition is changed it allows the opposing dies 90 to move with respect to each other as herein described.

The clutch 165 is used to drive the linkage members moving the die in a vertical direction in either a right or left rotational manner. The clutch coil to move the linkage system to the right is indicated in 165*a* and when activated by the die clutch brake power supply 462 and the normally open die clutch interlock relay contactors 394*d* are in a closed condition the linkage will be driven to the right and on the other hand when the clutch left coil, schematically indicated at 165*d* is activated the linkage moves in the opposite direction. The clutch left coil 165*b* is activated when the normally closed die clutch interlock relay contactors 394*e* remain in the closed position and when the die clutch brake power supply 462 supplies power thereto. When the condition of the relay contactors 394*e* are changed to an open position, the clutch left coil 165*b* is no longer activated.

It should be understood the general circuitry described hereinabove in connection with FIG. 23 serves to operate the opposing die 90 in a manner herein described in connection with the detailed mechanical description of those dies. The general steps that occur in this movement is of that the opposing dies 90 are moved from an open position to a separating position with the sheet 18 in register therebetween. The opposing dies 90 move in a direction transversely of the sheet feed direction and into mutual contact with the sheet 18 at a progression of locations across the sheet to separate the cards 20 from the scrap 22 while driven by the clutch brake type reversing drive whose control is described in connection with FIG. 23. The clutch brake type reversing drive is more particularly described in connection with clutch 165 in the drive train associated therewith.

The cards are then moved through the female die until the opposing dies 90 are in the separating position. The cards 20 are then moved through the cutout portion in the female die and received on the elevator platform. The height of the stack of cards on the elevator platform are sensed by means of switches as described in FIG. 24 in connection with elevator and the height of the elevator platform is properly adjusted as the height of the cards increases the platform is automatically moved down by means of the controls described herein, to accommodate additional cards.

Figure 22:
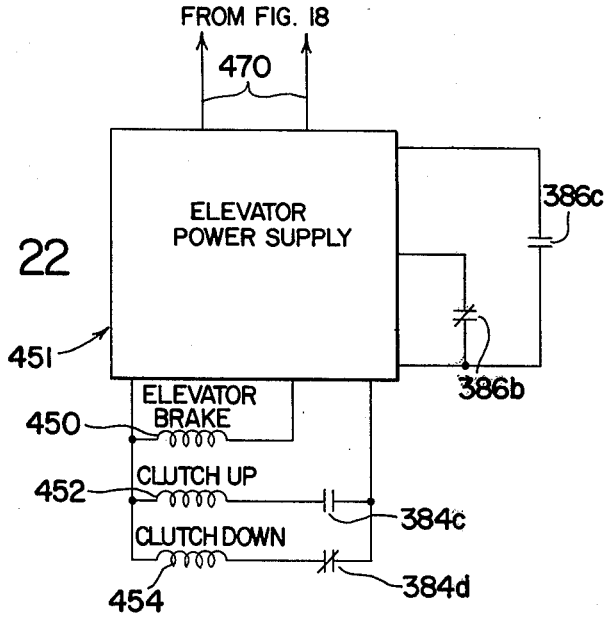
FIG. 22 is a schematic diagram of the elevator reversing drive power supply and associated circuitry.

Control circuitry generally shown in FIG. 22 is provided which includes supplying power through the leads 470 from the A-C power supply. The height of the elevator is controlled by the condition of the normally open activate elevator relay contactors 386*c* and the normally closed activate elevator relay contactors 386*b*. When the pile is too high or the pile is too low, as sensed by the switches 408, 410, the activate elevator or the manual switch 404 or 412 is activated and the level of the platform is changed as described in connection the circuitry in FIG. 24. The elevator brake coil 450 is connected to the control circuitry 451 to stop movement of the platform when movement of the platform is not activated by the control circuitry. The direction of travel of the platform in either an up or down position is controlled by the clutch up, schematically indicated at 452, and clutch down schematically indicated at 454 in FIG. 22. When the normally open elevator clutch interlock relay 384*c* is changed in condition to a closed condition, the platform is allowed to move in an upward direction by activation of the up clutch 452. When the elevator clutch interlock relay 384*d* which is normally closed remains in a normally closed condition and other events occur to activate downward movement of the platform, the down clutch 454 is activated to move the platform to a down position thereby adjusting the level of the platform by either manual or automatic sensing means. Thus the height of the stack of the cards 20 on the elevator platform are sensed by means of the detectors described hereinabove. The elevator platform is then moved by the circuitry described in FIG. 22, 24 and 24*a* to compensate for the additional cards received thereby.

After the opposing dies 90 have reached the card separating position they continue to move and return to an open position to actuate the initiating circuit to begin movement of the forwarding rolls 86, 87 and 88 as described by the circuitry in FIG. 24, 24*a* and FIG. 20. When the forwarding rolls 86, 87 and 88 are again activated, they expell the scrap from between the dies and feed a new sheet between the opposing dies 90 as hereinabove described.

Kick-out rollers 497, as seen in FIG. 6, are provided for gripping the scrap from the forwarding rollers and expelling the scrap from the separator machine 10. The kick-out rollers 497 are driven by a belt 493 on a pulley 491 mounted on the nip roll 50 and driving the kick-out rollers through pulley 495.

The switch 364 senses when the scrap has been removed from between the die and when the leading edge of the new sheet is in position so that the new sheet is in register between the opposing dies to thereby initiate movement of the opposing dies toward each other and separate the card from the scrap in the sheet.

I claim:

1. An apparatus for separating cards from the scrap of paperboard sheets from which they have been die cut except for small integral connecting tangs which includes in combination:

a base sheet feed means on said base including drive rollers for engaging said sheets only along the opposite margins of said sheets parallel to the direction of travel of said sheets;

said sheet feed means moving said sheets in a direction toward a pair of opposing dies mounted for relative movement transverse to said direction;

means stopping said sheets one at a time in register between said dies; and means relatively moving said dies into mutual contact with each sheet when said sheet is in register at a progression of locations across said sheet to complete separation of said cards from said scrap.

2. The apparatus of claim 1 in which said sheet feed means includes in addition to said drive rollers, a nip roll and cooperating idler rollers for initially advancing said sheets to said drive rollers and said nip roll and drive rollers are controlled to maintain a mutual peripheral velocity.

3. An apparatus for separating cards from the scrap of paperboard sheets from which they have been die cut except for small integral connecting tangs which includes in combination:

a base sheet feed means on said base;

said sheet feed means moving said sheets in a direction toward a pair of opposing dies mounted for relative movement transverse to said direction;

means stopping said sheets one at a time in register between said dies; and means relatively moving said dies into mutual contact with each sheet when said sheet is in register at a progression of locations across said sheet including links of different lengths acting simultaneously to relatively move one opposing pair of die sides into mutual contact with said sheet before the opposing opposite pair of die sides are relatively moved into mutual contact with said sheet to complete separation of said cards from said scrap.

4. The apparatus of claim 3 which includes means to drive one end of said links in one direction on one die stroke and in the opposite direction of the next die stroke.

5. The apparatus of claim 3 in which said opposing dies comprise a male and a female die and the upper die is the male die mounted on a die platen driven by said links.

6. An apparatus for separating a plurality of cards from the scrap of paperboard sheets from which they have been die cut except for small integral connecting tangs which includes in combination:

a base;

sheet means on said base;

said sheet feed means moving said sheets in a direction toward a pair of opposing dies mounted for relative movement transverse to said direction;

means stopping said sheets one at a time in register between said dies; and means relatively moving said dies into mutual contact with each sheet adjacent said tangs when said sheet is in register at a progression of locations across said sheet to complete separation of said cards from said scrap.

7. The apparatus of claim 1 in which said opposing dies are a male and a female die and the male die has a plurality of spaced projecting members for engaging portions of said cards of said sheet in the area of said tangs.

8. The apparatus of claim 7 in which said female die has a plurality of cutout portions in substantially the same arrangement and substantially the same shape as the die cut cards of a plurality of sheets to be separated into cards and scrap.

9. The apparatus of claim 1 in which said opposing dies are a male die and a female die and the upper die is the male die and the lower die is the female die and said female die includes a plurality of cutout portions of substantially the same arrangement and the same shape as said die cut cards of a series of said sheets to be separated into cards and scrap such that movement of said male die and said female die into mutual contact with said sheet progressively forces said cards from said scrap portion of said sheet, and through their respective cutout portions in said female die.

10. The apparatus of claim 9 which includes elevator means and said cards forced through the female die are stacked on a platform of said elevator means.

11. The apparatus of claim 10 in which said elevator means includes means to sense and signal to a prime mover the height of the stacks of said cards on said platform and includes means to gradually lower said elevator platform by means of said prime mover to accomodate the increasing stack height automatically in response to said signal.

12. An apparatus for separating cards from the scrap of paperboard sheets from which they have been die cut except for small integral connecting tangs which includes in combination:

a base;

sheet feed means on said base including drive rollers for engaging the scrap only along opposite outermost margins of the scrap portion of said sheets parallel to the direction of travel of the sheets;

said sheet feed means moving said sheets in a direction toward a pair of opposing dies including a male and a female die mounted for relative movement transverse to said direction, said male die having a plurality of spaced projecting members for engaging portions of said cards of said sheet in the area of said tangs;

means stopping said sheets one at a time in register between said dies; and means relatively moving said dies into mutual contact with each sheet when said sheet is in register at a progression of locations across said sheet to complete separation of said cards from said scrap.

13. A method for separating a plurality of cards from the scrap of paperboard sheets from which they have been die cut except for small integral connecting tangs comprising the steps of:

feeding the sheet to and positioning the sheet between a pair of opposing dies;

moving the opposing dies in a direction transversely of the sheet feed direction into mutual contact with the sheet adjacent said tangs in a progression of locations across the sheet to separate the cards from the scrap;

moving the opposing dies to the open position so as to allow the scrap portion of the sheet to be removed from between the opposing dies; and, receiving the cards after they are severed from the sheet.

14. A method for separating cards from the scrap of a plurality of paperboard sheets from which they have been die cut except for small integral connecting tangs comprising the steps of:

gripping the opposite margins of a sheet parallel to the direction of travel of the sheet with forwarding rolls;

advancing the sheet between a pair of opposing dies mounted to reciprocate between an open and a separating position to separate the card portions from the scrap portions;

moving the opposing dies from the open position to the separating position by contacting each of said cards at a plurality of locations adjacent said tangs to separate the card portions from the scrap portion of the sheet;

returning the opposing dies to the open position; and, removing the scrap from between the opposing dies by movement of the forwarding rolls and simultaneously putting a new sheet between the opposing dies.

15. The method of claim 14 in which the step of advancing the sheet occurs at two distinct velocities.

* * * * *